US011549256B2

(12) United States Patent
Sander et al.

(10) Patent No.: US 11,549,256 B2
(45) **Date of Patent: *Jan. 10, 2023**

(54) METHOD AND APPARATUS FOR SEALING GROUT SPACE

(71) Applicants: Scott W. Sander, North Canton, OH (US); Ronald Glaze, Canton, OH (US)

(72) Inventors: Scott W. Sander, North Canton, OH (US); Ronald Glaze, Canton, OH (US)

(73) Assignee: Scott W. Sander, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/192,353

(22) Filed: Mar. 4, 2021

(65) Prior Publication Data

US 2021/0189718 A1 Jun. 24, 2021

Related U.S. Application Data

(63) Continuation-in-part of application No. 16/298,177, filed on Mar. 11, 2019, now Pat. No. 10,954,669.

(60) Provisional application No. 62/641,485, filed on Mar. 12, 2018.

(51) Int. Cl.
*E04B 1/70* (2006.01)
*E04B 1/68* (2006.01)

(52) U.S. Cl.
CPC ..... *E04B 1/7038* (2013.01); *E04B 1/6803* (2013.01)

(58) Field of Classification Search
CPC ..... E04B 1/6803; E04B 1/7038
USPC ..... 52/169.5
See application file for complete search history.

(56) References Cited

U.S. PATENT DOCUMENTS 2,146,775 A ‡ 2/1939 Stoutenburgh ..... E04B 1/7023 52/169.5
3,293,810 A ‡ 12/1966 Cox ..... E04B 1/644 52/302.6
3,942,292 A ‡ 3/1976 Robinson ..... E04B 1/7046 52/204.2
4,106,247 A ‡ 8/1978 Svensson ..... E04C 3/02 52/204.2
4,202,143 A ‡ 5/1980 Mear ..... E04B 1/7046 52/204.2
4,280,308 A * 7/1981 Svensson ..... E04C 3/02 52/98
4,282,691 A ‡ 8/1981 Risdon ..... E04B 1/644 52/101
4,798,033 A * 1/1989 Weidl ..... E04D 13/155 52/60

(Continued)

*Primary Examiner* — James M Ference
(74) *Attorney, Agent, or Firm* — Sand, Sebolt & Wernow Co., LPA

(57) ABSTRACT

An apparatus and method for sealing a grout space provided between a backing wall and a veneer layer. The grout space sealing apparatus includes a deflector that is installed at an intersection of a backing wall and a horizontal surface and a sealing member that is positionable over the deflector and extends onto the backing wall above the deflector and/or across the horizontal surface in front of the deflector. The grout space sealing apparatus causes water that has permeated the exterior veneer to run down an exterior surface of the sealing member. The water is directed along the exterior surface of the sealing member away from the backing wall and towards weep holes provided in the veneer.

18 Claims, 14 Drawing Sheets

(56) References Cited

U.S. PATENT DOCUMENTS 4,841,687 A ‡ 6/1989 Navetta ..... E04B 1/7023 52/204.1
4,852,320 A ‡ 8/1989 Ballantyne ..... E04B 1/4178 52/302.3
4,879,851 A ‡ 11/1989 Boccia ..... E02D 31/02 52/302.3
4,947,600 A * 8/1990 Porter ..... E04F 13/0862 52/387
5,349,792 A ‡ 9/1994 Bayes ..... E04B 1/7046 52/412
5,630,297 A ‡ 5/1997 Rutherford ..... E04B 1/66 52/371
5,692,348 A ‡ 12/1997 Ambrosino ..... E04B 1/70 405/43
5,794,388 A ‡ 8/1998 Jackman ..... E04B 1/7023 405/36
5,815,986 A ‡ 10/1998 Laska ..... E04B 1/703 52/62
5,819,478 A ‡ 10/1998 Bayes ..... E04B 1/644 52/62
5,979,123 A ‡ 11/1999 Brockman ..... A01M 1/24 49/58
6,023,892 A ‡ 2/2000 Sourlis ..... E04B 1/644 210/170.01
6,029,405 A ‡ 2/2000 Wood ..... E04H 3/14 52/2.23
6,052,959 A ‡ 4/2000 LaBrosse ..... E04B 1/7076 248/48.1
6,073,400 A * 6/2000 Balisle ..... E04D 13/0459 52/96
6,101,767 A * 8/2000 Georgeau ..... E04D 13/15 52/96
6,122,874 A ‡ 9/2000 Smerilli ..... E04B 1/644 52/169.14
6,449,910 B1 * 9/2002 Budd ..... E04D 13/15 52/96
6,634,144 B1 ‡ 10/2003 Moore ..... E02D 31/02 405/38
6,681,530 B1 ‡ 1/2004 Givens ..... E04D 13/1407 108/16
6,883,284 B1 ‡ 4/2005 Burgunder ..... E04F 17/00 52/169.5
7,546,719 B1 ‡ 6/2009 Guevara ..... E04F 13/06 52/302.6
7,676,996 B2 ‡ 3/2010 Teodorovich ..... E06B 1/62 52/204.2
7,823,355 B1 ‡ 11/2010 Hohmann, Jr. ..... B32B 5/26 428/295.1
7,900,404 B2 ‡ 3/2011 Koch ..... E04B 1/7046 52/169.5
8,046,956 B1 ‡ 11/2011 Hohmann, Jr. ..... E02D 31/02 428/349
8,109,046 B2 ‡ 2/2012 Nordhoff ..... E04B 1/7023 52/169.5
8,281,530 B2 ‡ 10/2012 Chaussee ..... E04F 13/0803 52/290
8,312,682 B2 ‡ 11/2012 Trotter ..... E04B 1/7023 52/169.5
8,443,554 B1 * 5/2013 Teodorovich ..... E06B 1/705 52/204.5
8,522,508 B1 * 9/2013 Collins ..... E04B 1/7046 52/61
8,910,430 B2 * 12/2014 Argiropoulos ..... E04D 13/155 52/96
9,097,006 B2 ‡ 8/2015 Johnson ..... E04B 1/64
9,316,004 B1 ‡ 4/2016 Hatzinikolas ..... F16M 13/02
9,447,585 B2 ‡ 9/2016 Hatzinikolas ..... E04B 1/40
9,797,130 B2 * 10/2017 Collins ..... E04B 1/7053
9,845,634 B2 * 12/2017 Heid ..... E06B 7/14
10,273,741 B1 ‡ 4/2019 Summy ..... E06B 1/62
10,954,669 B2 * 3/2021 Sander ..... E04B 1/7038
2002/0115367 A1 ‡ 8/2002 Lolley ..... B32B 15/14 442/6
2002/0139060 A1 * 10/2002 Contreras ..... E04B 1/762 52/293.3
2003/0126810 A1 ‡ 7/2003 Brunson ..... E04B 1/7061 52/169.5
2003/0230035 A1 ‡ 12/2003 Collins ..... E04B 1/70 52/209
2004/0003558 A1 ‡ 1/2004 Collins ..... E04B 1/4178 52/302.1
2005/0198916 A1 ‡ 9/2005 Janesky ..... E02D 31/02 52/169.5
2006/0032158 A1 ‡ 2/2006 Moule ..... E02D 31/06 52/169.5
2006/0112653 A1 ‡ 6/2006 Hogenson ..... E02D 31/02 52/169.5
2006/0117687 A1 ‡ 6/2006 Ehrman ..... E04B 1/7061 52/302.1
2006/0137289 A1 ‡ 6/2006 Cotten ..... E02D 31/02 52/717.02
2006/0207195 A1 ‡ 9/2006 Donoho ..... E04B 1/72 52/101
2006/0254169 A1 ‡ 11/2006 McFadden ..... E04F 13/06 52/344
2007/0062137 A1 * 3/2007 Maylon ..... E04F 13/06 52/367
2007/0068093 A1 ‡ 3/2007 Grange ..... E02D 31/02 52/97
2008/0104918 A1 ‡ 5/2008 Gleeson ..... E04B 1/74 52/489.1
2009/0090068 A1 ‡ 4/2009 O'rourke ..... E06B 1/62 52/58
2010/0088983 A1 ‡ 4/2010 Bailey ..... E04F 13/06 52/204.2
2011/0302862 A1 ‡ 12/2011 Lloyd ..... E02D 27/02 52/293.3
2011/0302863 A1 ‡ 12/2011 Sourlis ..... E02D 19/00 52/302.1
2016/0069071 A1 ‡ 3/2016 Remmele ..... E04F 13/068 52/232
2017/0204602 A1 ‡ 7/2017 Collins ..... E04B 1/7053
2017/0254091 A1 ‡ 9/2017 Friel ..... E04B 1/765
2019/0277025 A1 ‡ 9/2019 Sander ..... E04B 1/6803
2021/0189718 A1 * 6/2021 Sander ..... E04B 1/6803

* cited by examiner
‡ imported from a related application

METHOD AND APPARATUS FOR SEALING GROUT SPACE

CROSS REFERENCE TO RELATED APPLICATIONS

This application is a continuation-in-part of U.S. application Ser. No. 16/298,177, filed on Mar. 11, 2019, which claims the benefit of U.S. Provisional Application Ser. No. 62/641,485, filed on Mar. 12, 2018; the entirety of which are incorporated herein by reference.

BACKGROUND

Technical Field

The present disclosure relates generally to the field of construction. More particularly, the present disclosure relates to the construction of buildings that have an exterior brick veneer and a backing wall with a grout space located between them. Specifically, the present disclosure relates to an apparatus and method for quickly, uniformly, and efficiently sealing the grout space between the exterior brick veneer and the backing wall.

Background Information

When building a home or a commercial building that is to be finished with a brick or stone veneer it is common practice to use cinder blocks or wood framing and plywood sheets as an exterior wall and to then face that exterior wall with the brick or stone veneer. The exterior wall may also be referred to as a "backing wall". A space is typically left between the backing wall and the veneer and this space is commonly known as a "grout space". Weep holes are intentionally left at intervals along a bottom region of the veneer. The weep holes are in fluid communication with the grout space. The grout space allows water that seeps through the veneer to run down an interior surface of the veneer or down an exterior surface of the backing wall and to flow out of the weep holes.

Current practice is to seal a base of the backing wall with grout, particularly where the base meets a horizontal surface, such as a slab, the top of a block course, a foundation, or the like. The grout is typically contoured to help direct water downwardly and forwardly away from the backing wall and towards the weep holes. The installation of grout can be a labor-intensive and time-consuming job and is best done by a skilled workman since it requires manual application and proper contouring. Additional time is also required to allow the grout to cure. If the grout is installed hastily, is applied by an inexperienced workman, or is cured under adverse conditions, the end-product may have a non-uniform thickness or an uneven contour and pockets may form in the grout. Water seeping through the veneer may land up pooling in these pockets. In other instances the grout may unintentionally dip or angle backwardly towards the backing wall instead of forwardly towards the veneer and the weep holes. Water seeping through the veneer may then flow backwardly towards the backing wall and this can cause moisture related issues, such as mold, within the interior of the building.

Other known solutions for sealing grout spaces include utilizing flashing between the veneer and the backing wall to help direct water away from the backing wall and outwardly towards the weep holes. Metal flashing or flexible rubber flashing may be used for this purpose. Metal flashing tends to be expensive and may be time-consuming to install properly. If flexible flashing is installed with improper support beneath the flashing then, over time, this type of flashing can sag or deteriorate and ultimately lead to moisture coming into contact with the backing wall.

SUMMARY

The present disclosure is related to a fast, efficient, and uniform way to seal grout spaces that will tend to consistently direct water away from a backing wall and out through the weep holes left in the exterior veneer. Additionally provided is a moisture deflection solution that can be installed by an average worker without affecting the properties of the sealed grout space.

In one aspect, the present disclosure may provide a deflector for sealing a grout space comprising: a bottom face having a first portion and a second portion; a front face in operable connection to the bottom face and oriented at an angle thereto, wherein the first portion of the bottom face extends forward of the front face; and a rear face extending upwardly from the bottom face and oriented at an angle of approximately 90 degrees relative thereto, wherein the rear face is adapted to be positioned parallel to the backing wall; the deflector being adapted to be installed between a backing wall and an exterior veneer with the first portion of the bottom face secured between a first layer and a second layer of the exterior veneer.

In another aspect, the present disclosure may provide a method of sealing a grout space provided between a backing wall and a veneer layer, comprising: placing a deflector between a backing wall and an exterior veneer of a building; removing at least a portion of one or more of a front face, a rear face, and a bottom face of the deflector along one or more pre-scored cut lines formed thereon; adjoining a first section and a second section of the deflector to each other to create a corner in the deflector complementary to a corner of the backing wall; securing a first portion of the bottom face of the deflector between a first layer of the veneer and a second layer of the veneer to support the deflector in position between the backing wall and the exterior veneer; directing water that has permeated the veneer layer along the exterior face of the sealing member away from the backing wall and towards the veneer layer; and draining the water out of the veneer layer via one or more weep holes.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
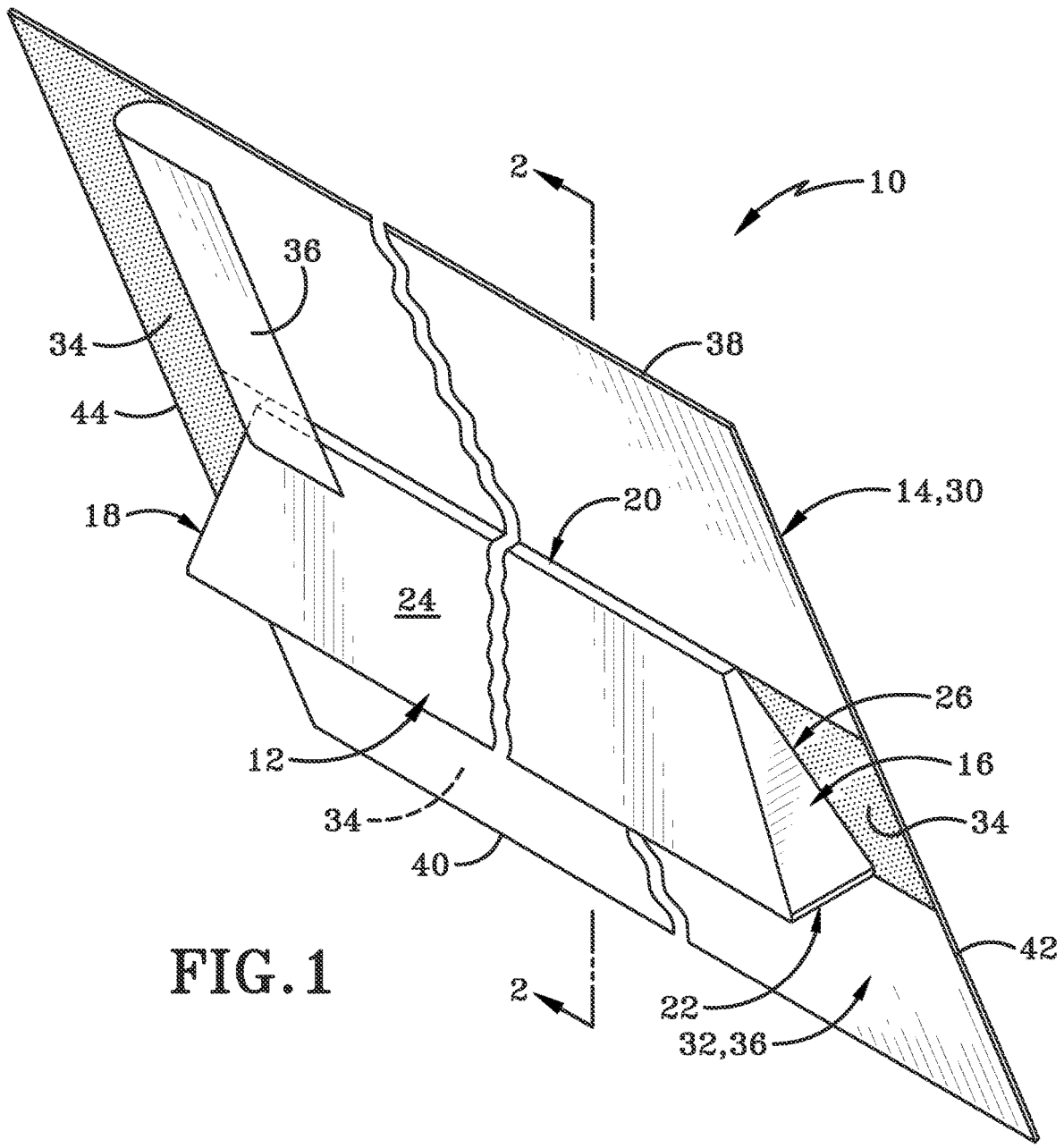
FIG. 1 is a top back perspective view of a first embodiment grout sealing device in accordance with the present disclosure, wherein the device includes a deflector and a sealing member.
Figure 2:
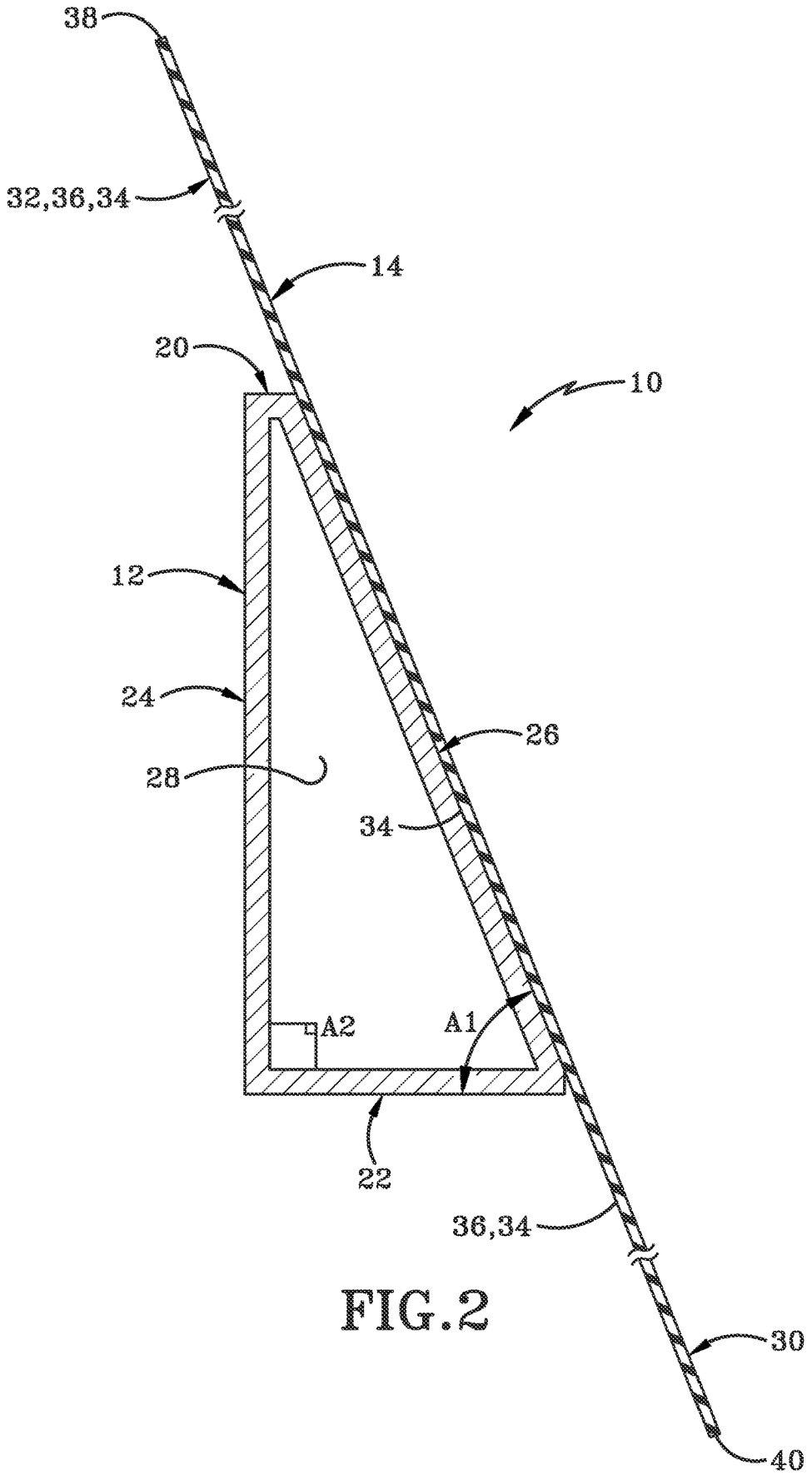
FIG. 2 is a cross-section taken along line 2-2 of FIG. 1.
Figure 3:
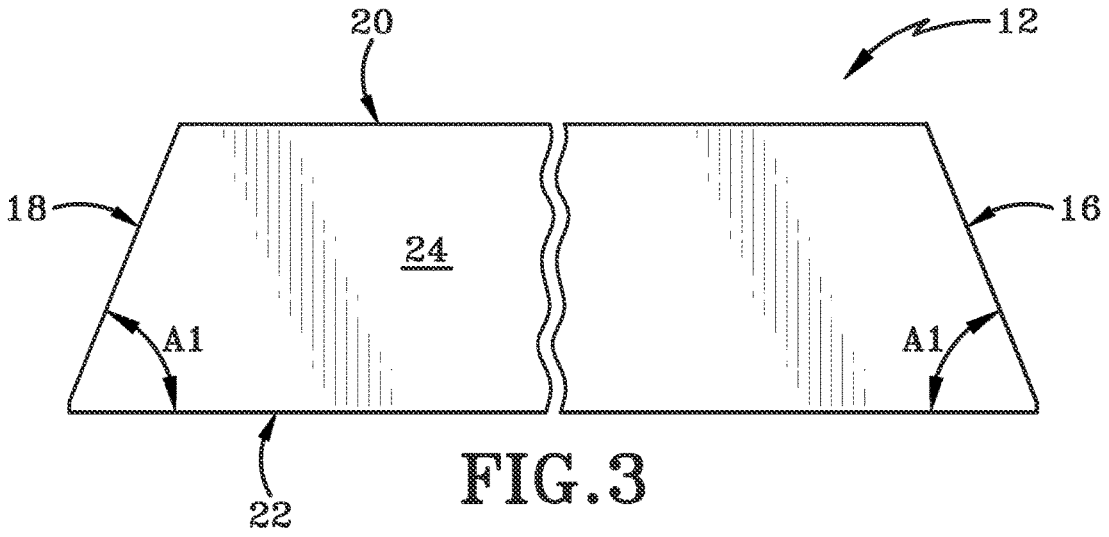
FIG. 3 is a rear elevation view of the deflector of the grout sealing device of FIG. 1 shown on its own.
Figure 13:
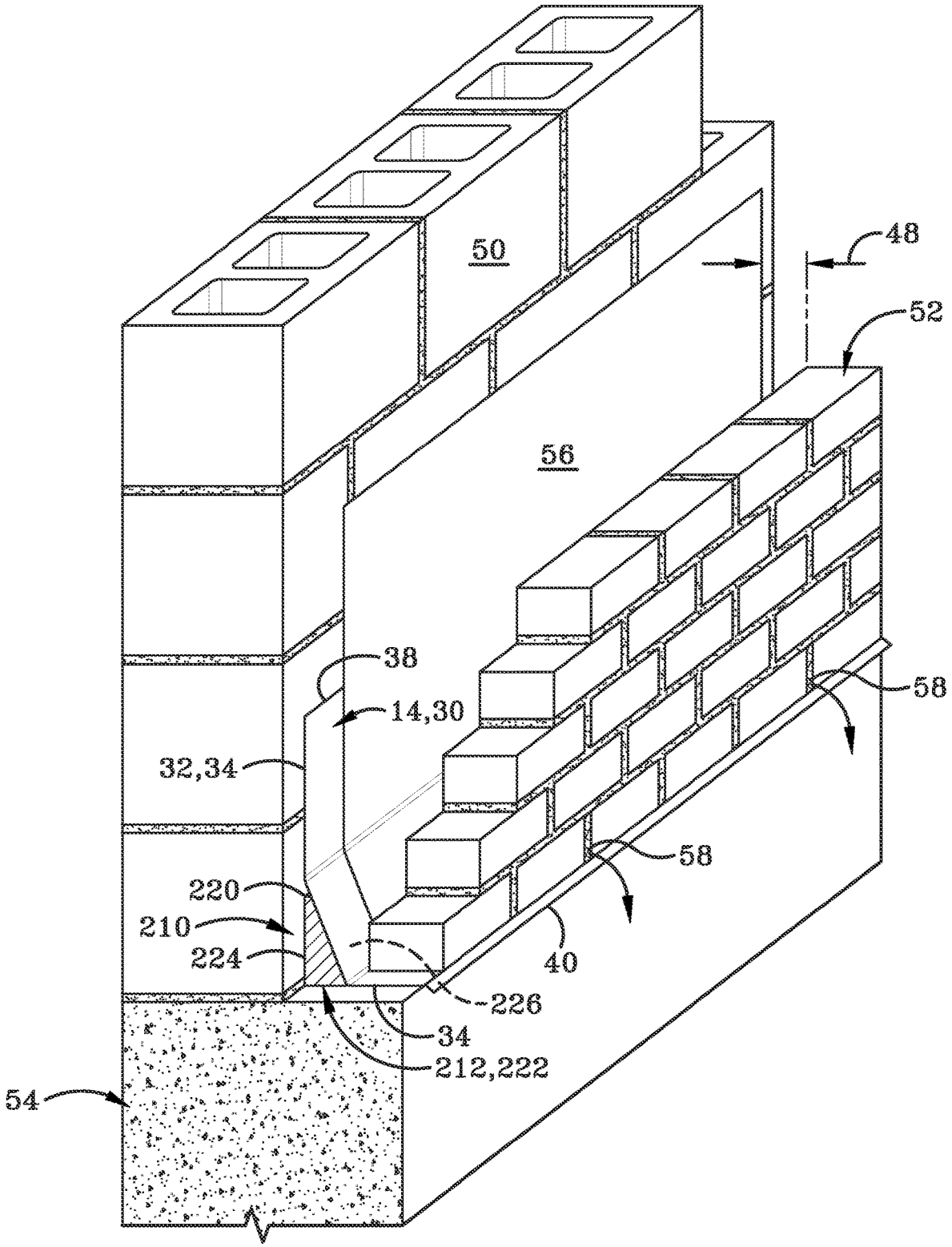
FIG. 13 is a partial cross-section top perspective view of the third embodiment of the grout sealing device shown installed in the grout space between a cinder block backing wall and an exterior veneer.
Figure 14:
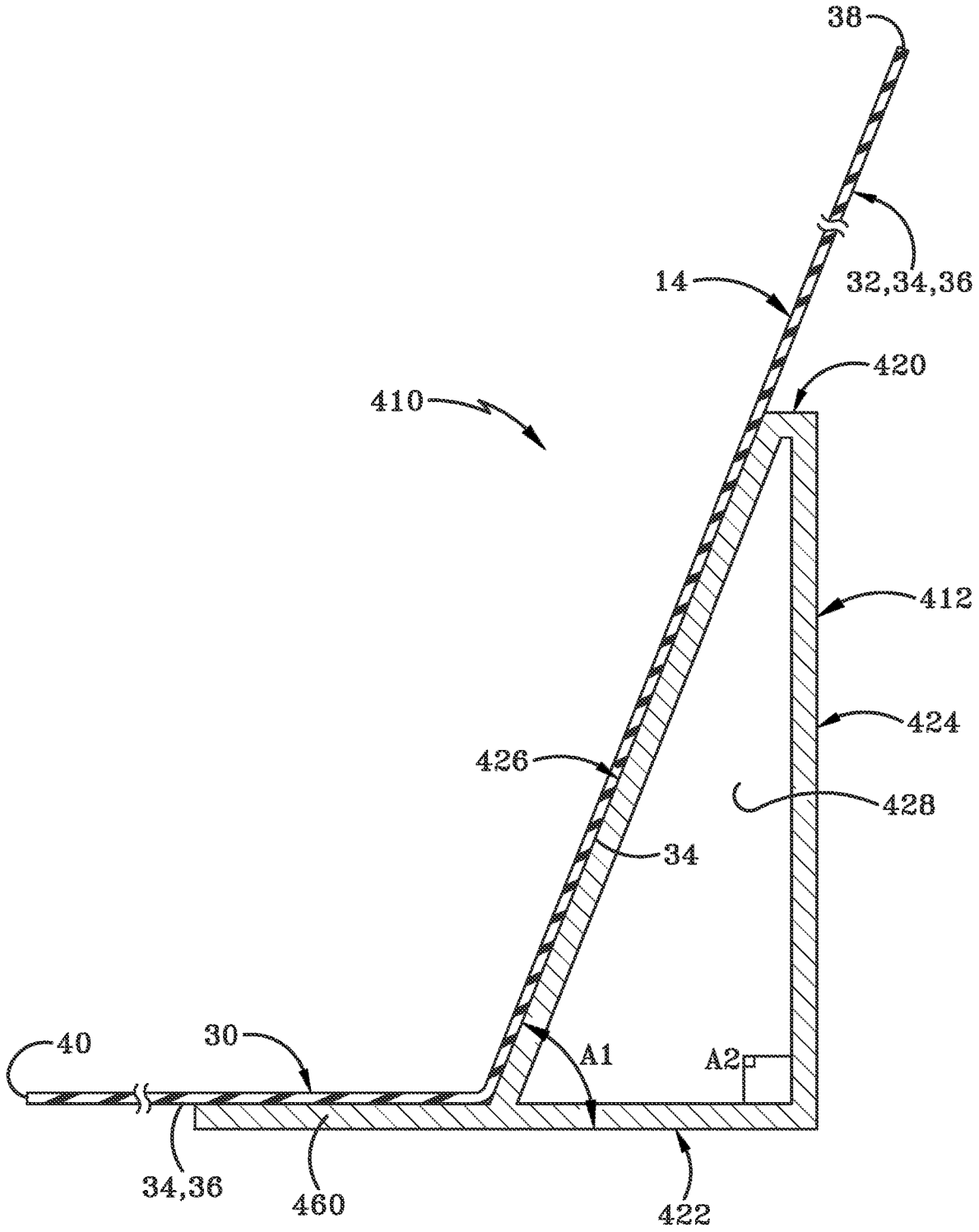
FIG. 14 is a cross section side view of a fifth embodiment of a grout sealing device according to one aspect of the present disclosure.

With reference to FIGS. 1 to 3, a grout sealing device in accordance with an aspect of the present disclosure is shown and generally indicated at reference 10. Grout sealing device 10 may include a deflector 12 and a sealing member 14. Sealing member 14 is best seen in FIGS. 1, 2, and 14, and may also be seen in FIGS. 12, 13, and 18. Sealing member 14 has been removed from FIGS. 3-11 and 15-17 for clarity of illustration.

With reference to FIGS. 1-3, a first embodiment of a deflector 12 in accordance with an aspect of the present disclosure, may comprise an elongate, generally rigid component having a first end 16, a second end 18, a top face 20, a bottom face 22, a rear face 24, and a front face 26. First and second ends 16, 18 may be spaced apart and may define a longitudinal direction therebetween. Top surface and bottom face 20, 22 may be spaced apart and may define a vertical direction therebetween. Rear and front faces 24, 26 may be spaced apart and may define a horizontal direction therebetween. According to another aspect, as best seen in FIG. 2, first end 16, second end 18, top face 20, bottom face 22, rear face 24, and front face 26 bound and define a generally hollow interior 28. Providing the hollow interior 28 reduces the overall weight of deflector 12 making it easier to handle and less expensive to fabricate.

Deflector 12 may be formed from a rigid or a semi-rigid material that tends to hold its shape over time while resisting corrosion or deterioration. According to one aspect, one suitable material may be a plastic such as polyvinyl chloride (PVC). According to another aspect, other plastics or materials may also be used according to the desired implementation. Deflector 12 may be formed as a single, unitary monolithic piece by extrusion or rotational molding. In other examples, deflector 12 may be manufactured in separate pieces that may be adhered together with an adhesive, an epoxy, a thermoplastic resin, or by any other methods and materials. Where deflector 12 is manufactured using individual pieces for the first end 16, second end 18, top face 20, bottom face 22, rear face 24, and front face 26, the joints between adjacent faces may be sealed in a suitable manner so that deflector 12 is substantially watertight.

Deflector 12 may be generally triangular in shape when viewed from either of the first end 16 or second end 18. In particular, deflector 12 may be in the shape of a right-angled triangle with bottom face 22 and rear face 24 oriented substantially at right angles to each other. (The right angle is indicated as angle "A" in FIG. 2.) Front face 26 forms the hypotenuse of the right-angled triangle. According to one aspect, deflector 12 may be a truncated right-angled triangle since top face 20, which extends between rear face 24 and front face 26, need not be an inverted V-shape but can, instead, be a planar surface. According to another aspect, the intersection or corner between front face 26 and bottom 20 may be somewhat truncated in that a portion thereof may be removed.

Figure 12:
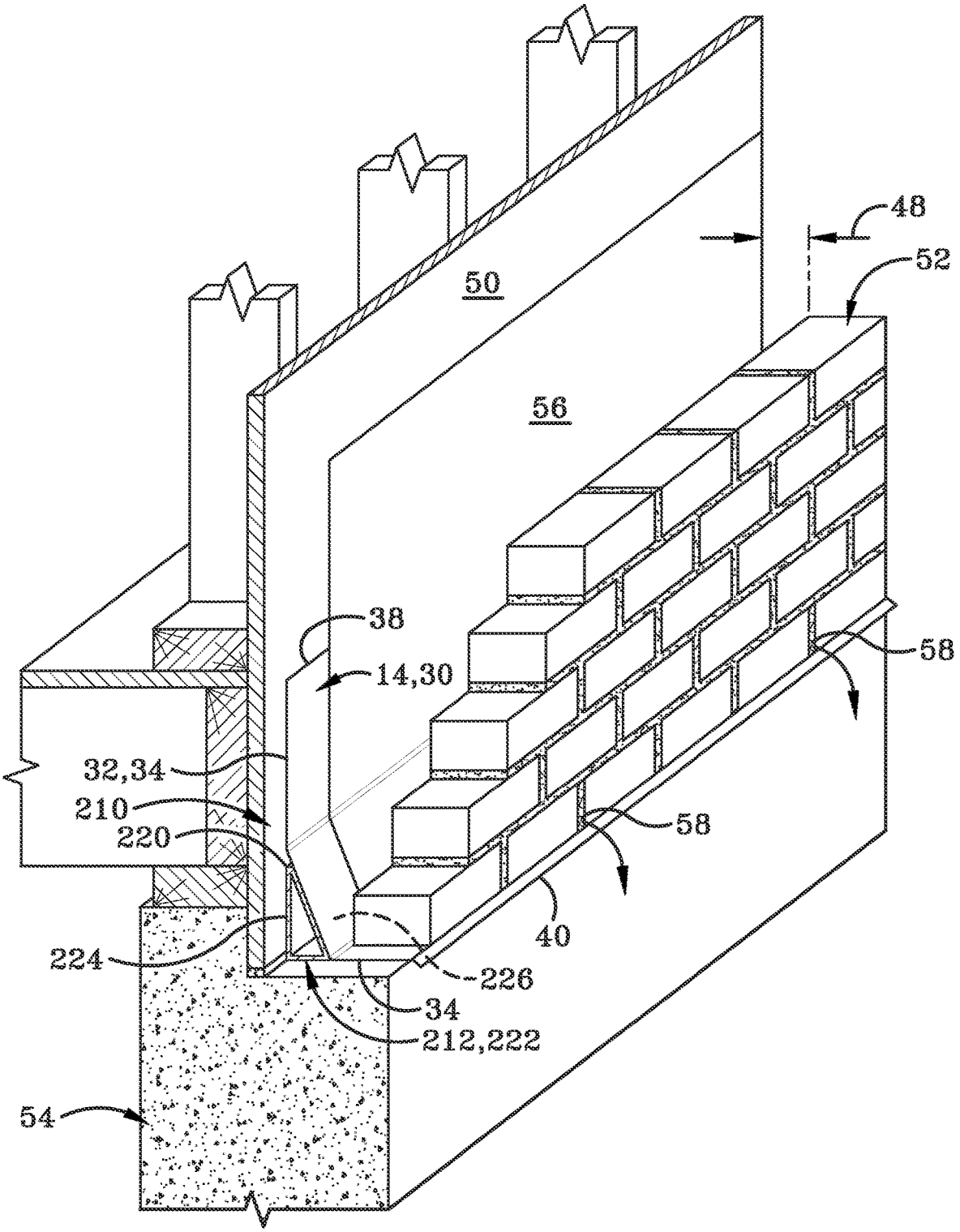
FIG. 12 is a partial cross-section top perspective view of the third embodiment of the grout sealing device shown installed in the grout space between a wood backing wall and an exterior veneer.

Rear face 24 of deflector 12 may be configured to abut a backing wall 50 of a structure while bottom face 22 may be configured to sit on or otherwise abut a horizontal surface 54 that intersects backing wall 50, as discussed further herein. Backing wall 50 may be a wood framed and plywood sheet wall (as best seen in FIG. 12), a cinder block wall (FIG. 13), or any other suitable backing wall 50 of a structure. Horizontal surface 54 may be a concrete slab, a foundation, a block course of a foundation, a block course header, an "L-block", a floor, or any other horizontal surface that perpendicularly intersects or adjoins backing wall 50. As depicted in the figures, horizontal surface 54 is shown as concrete, however, any suitable material may be used as dictated by the specific construction of the building and surrounding grade.

According to one aspect, as illustrated in the attached figures, front face 26 of deflector 12 may be substantially planar and disposed entirely in one plane. In other examples, however, front face 26 of deflector 12 may be curved, being either concavely or convexly shaped. In other examples, front face 12 may have an irregular shape.

First and second ends 16 and 18 may be angled such that the top face 20 of deflector 12 may be shorter in longitudinal length (i.e., with the longitudinal length being measured from first end 16 to second end 18) than the longitudinal length of bottom face 22. This angling of first and second ends 16, 18 gives deflector 12 an overall trapezoidal shape when viewed from the front or back, as best seen in FIG. 3. In particular, the front and back faces 126 and 124 may be an isosceles trapezoid. According to one aspect, the side edges of front face 26 and the first and second ends 16 and 18 are angled at approximately 60° (indicated in FIG. 3 as angle A1) relative to bottom face 22 to approximately match the slope of front face 26, as discussed later herein. According to another aspect, first and second ends 16 and 18 may be end caps that may be removable or separable from deflector 12.

It will be understood that although grout sealing device 10 has been illustrated and described as a triangularly-shaped deflector 12 that is utilized in conjunction with sealing member 14; other differently shaped "deflectors" may be utilized instead. For example, the "deflector" may be square or rectangular or any other suitable shape that can cause water to be kept away from a backing wall 50 or directed away from the backing wall 50 and/or towards weep holes 58, as discussed further herein.

According to another aspect, the generally hollow interior 28 of deflector 12 may be filled with, or otherwise contain, insulating material or structural support material. By way of non-limiting examples, hollow interior 28 of deflector 12 may be filled with high density foam, expanding foam, structural foam, fiberglass insulation, blown insulation, grout, cement, or any other suitable material or desirable combination thereof. According to another aspect, deflector 12 can be formed of a solid material. In other words, hollow interior 28 may be omitted from deflector 12.

Sealing member 14 may be an elongate and generally flexible component that may be positioned over at least a portion of deflector 12. Sealing member 14 may extend for a distance upwardly beyond a top edge of front face 26 of deflector 12. Sealing member 14 may further extend for a distance downwardly and/or forwardly beyond the bottom edge of front face 26 of deflector 12.

Sealing member 14 may be a flexible sheet that is fabricated from a water-resistant or water impermeable material. By way of non-limiting examples, sealing member 14 may be any known flashing material, including but not limited to metal, treated paper, rubberized asphalt, butyl rubber, polyvinylidene fluoride, or acrylic. Sealing member 14 may have a front face 30 and a rear face 32. Front face 30 may be the surface facing away from the deflector 12 while rear face 32 may be the surface facing towards and/or in contact with deflector 12. Sealing member 14 may further include a top edge 38, a bottom edge 40, a first side edge 42, and a second side edge 44. Top edge and bottom edge 38, 40, may be spaced apart along a vertical direction. First side edge and second side edge 40, 42 may be spaced apart along a longitudinal direction therebetween. Front face 30 and rear face 32 may further define a thickness of sealing member 14.

In some instances an adhesive layer 34 may be provided on rear face 32. A removable backing 36 may overlay the adhesive layer 34 to prevent sealing member 14 from adhering to other surfaces prior to installation. Removable backing 36 may also protect the adhesive layer 34 from being contaminated by foreign material, such as dust or construction debris, prior to installation of sealing member 14. Backing 36 may be removed at the time that sealing member 14 is installed in grout space 48 over deflector 12. Sealing member 14 may be adhered to front face 26 of deflector 12 such that the top edge 38 of sealing member 14 may extend beyond top face 20 of deflector 12 while bottom edge 40 of sealing member 14 may extend beyond bottom face 22 of deflector 12. First side edge 42 of sealing member 14 may extend beyond first end 16. Likewise second side edge 44 of sealing member 14 may extend beyond second end 18. According to another aspect, first side edge 42 and/or second side edge 44 of sealing member 14 may be flush with one or both of first end 16 and/or second end 18 of deflector 12, respectively.

Sealing member 14 may be engaged or otherwise affixed to front face 26, or over front face 26, of deflector 12 through application of adhesive layer 34 as described above or through other methods. Other methods of engaging sealing member 14 over deflector 12 may include, but are not limited to, clips, screws, nails or other fasteners. According to this aspect, when attaching sealing member 14 to deflector 12 using nails, screws, or other piercing attachments, it should be understood that any holes created in sealing member 14 may be sealed or otherwise treated to maintain the water-resistant or water impermeable properties of sealing member 14. For example, where sealing member 14 is engaged through the use of piercing fasteners such as nails, the heads of the nails may be covered with epoxy, caulk, or another similar water impermeable sealant.

Figure 5:
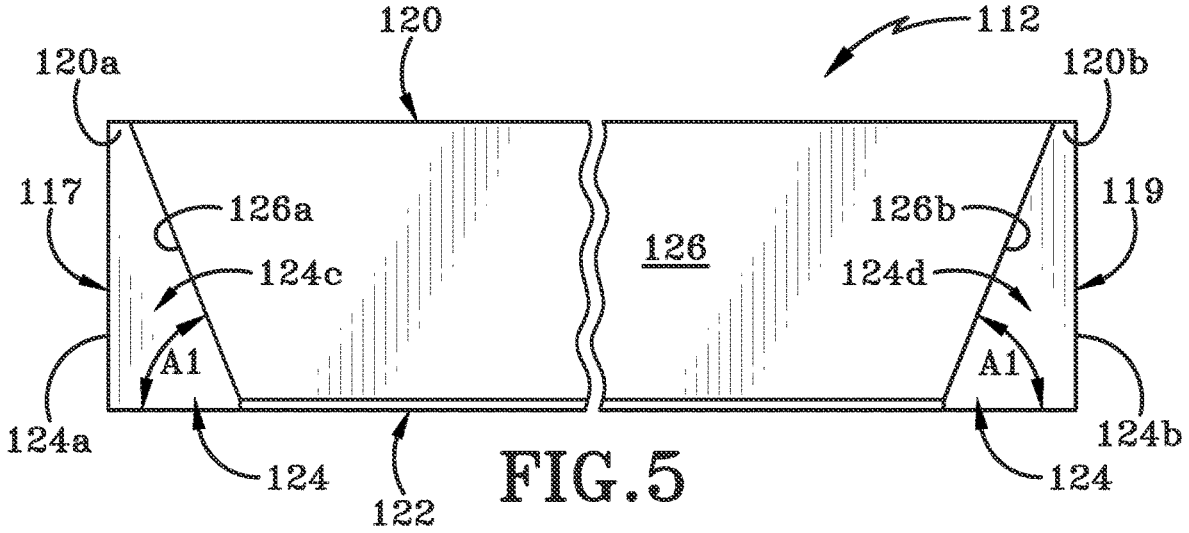
FIG. 5 is a front elevation view of the deflector of FIG. 4.
Figure 4:
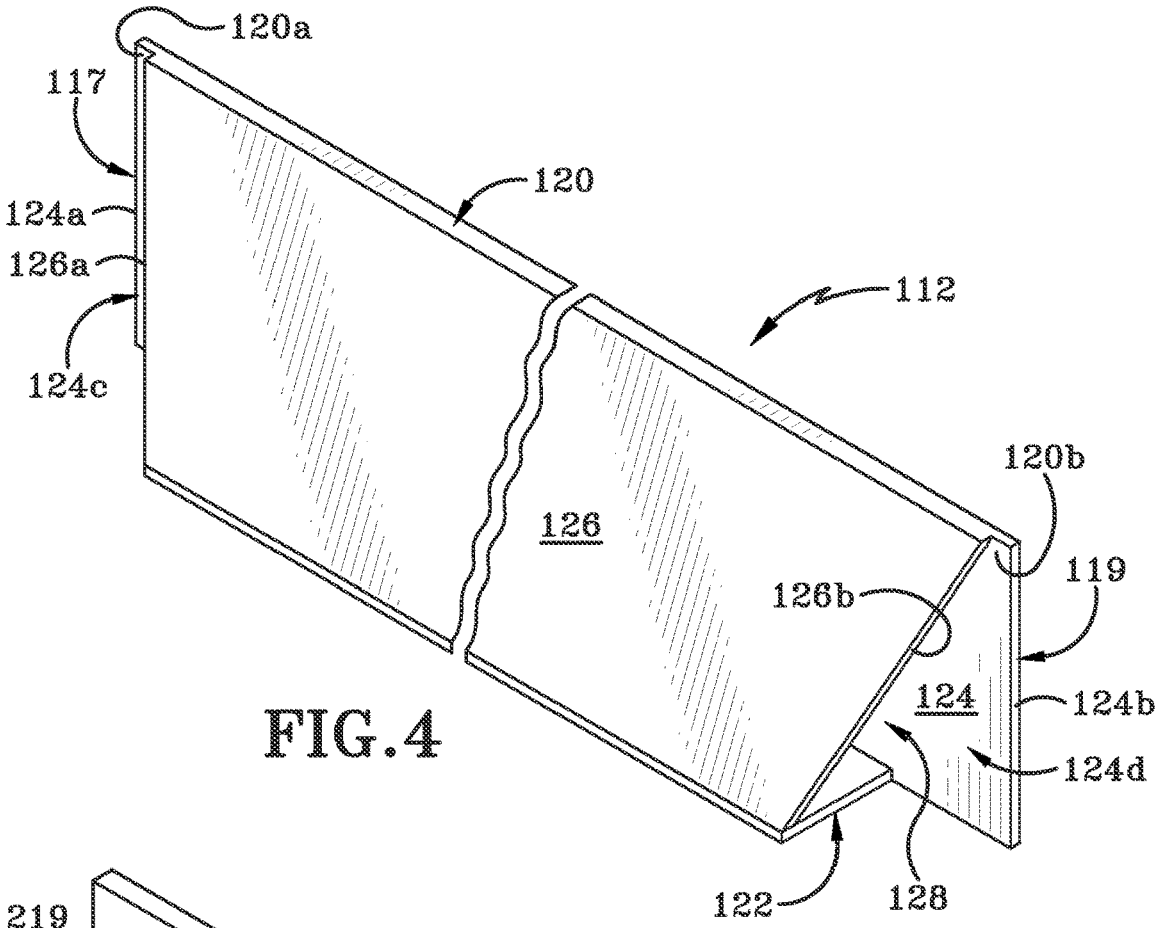
FIG. 4 is a top front perspective view of a second embodiment of the deflector in accordance with the present disclosure.

With reference to FIGS. 4 and 5, a second embodiment of deflector is shown and indicated as reference 112. Deflector 112 is substantially similar to deflector 12 except for a few features that will be discussed hereafter. Firstly, rear face 124 of deflector 112 is of a different shape to the shape of rear face 24 of the deflector 12. The rear face 24 of deflector 12 is an isosceles trapezoid while the rear face 124 of deflector 112 is substantially rectangular. In other words, the first and second side edges 124*a*, 124*b* of rear face 124 are oriented generally at right angles to a top edge and bottom edge of rear face 124 instead of being inclined at an angle other than 90° relative to the top and bottom edges.

Additionally, the shape of rear face 124 and the shape of front face 126 are not the same. Front face 126 is an isosceles trapezoid (substantially similar to the shape of front face 26 of deflector 12, but as an inverted mirror image thereof) but the rear face 124, as indicated above, is a rectangle. The first and second side edges 126*a*, 126*b* of front face 126 are oriented at about 60° relative to a bottom edge of front face 126 and first and second side edges 126*a*, 126*b* angle upwardly and outwardly toward a top edge of front face. As a consequence, a generally triangular-shaped first region 124*c* of rear face 124 extends outwardly beyond first side edge 126*a* of front face 126 and a generally triangular-shaped second region 124*d* of rear face 124 extends outwardly beyond second side edge 126*b*. These regions 124*c*, 124*d* can best be seen in FIG. 5. It should be noted that, as with deflector 12, rear face 124 of deflector 112 is oriented at a right angle to bottom face 122 and front face 126 forms the hypotenuse of the right angled triangle of deflector 112.

Still further, a portion of top face 120 extends outwardly beyond first side edge 126*a* and beyond second side edge 126*b*. A notch 120*a*, 120*b* is cut out of top face 120 between each of the first side edges 124*a*, 126*a* and second side edges 124*b*, 126*b*, respectively. Furthermore, a portion of bottom face 122 extends outwardly beyond first side edge 126*a* and beyond second side edge 126*b*. As a consequence, first and second side edges 126*a*, 126*b* of front face 126 are indented relative to the first and second side edges 124*a* and 124*b* of rear face 124 and these indentations behind portions 124*c*, 124*d* make it possible to overlap deflectors to form interior and exterior corners, as will be later described herein.

Deflector 112 also differs from deflector 12 in that deflector 112 has a first end 117 and a second end 119 that are open and thereby permit access to a hollow interior 128 of deflector 112 instead of having first and second ends 16 and 18 on deflector 12 that are closed and prevent access to the hollow interior 28. First open end 117 is bounded and defined by first side edge 124*a*, a portion of top face 120, first side edge 126*a* and a portion of bottom face 122. Second open end 119 is bounded and defined by second side edge 124*b*, a portion of top face 120, second side edge 126*b*, and a portion of bottom face 122.

Figure 7:
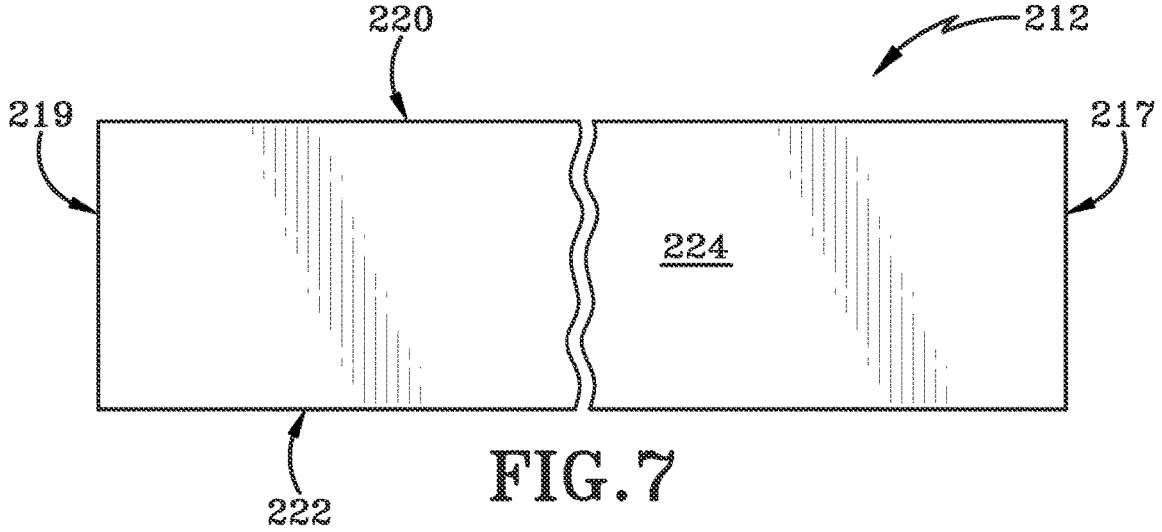
FIG. 7 is a rear elevation view of the deflector of FIG. 6.
Figure 6:
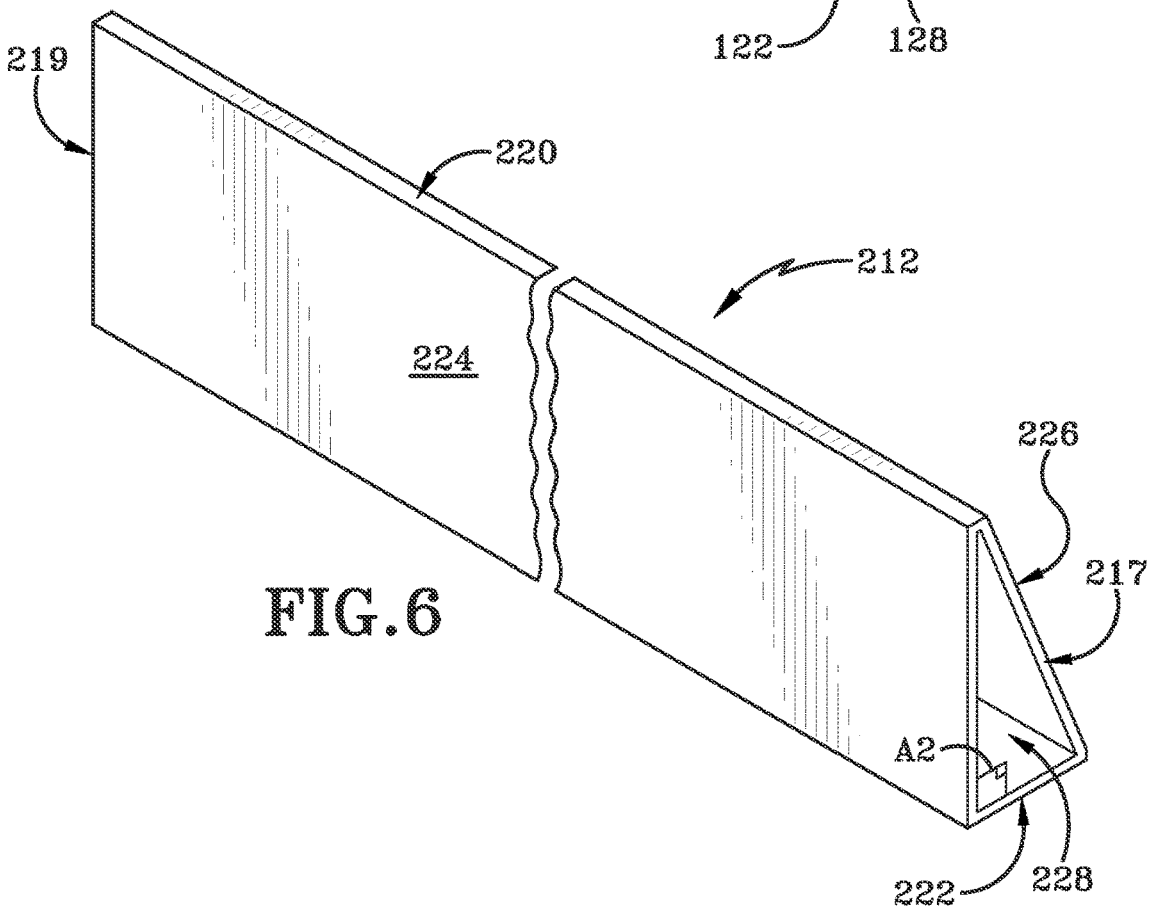
FIG. 6 is a top rear perspective view of a third embodiment of a deflector in accordance with the present disclosure.

With reference to FIGS. 6 and 7 a third embodiment of deflector is shown and generally indicated by the reference 212. Deflector 212 is substantially similar to deflectors 12 and 112 except for features that will be discussed further herein. Deflector 212 may have first and second ends 217 and 219 (similar to open ends 117 and 119) that permit access to hollow interior 228 Additionally, front and rear faces 224 and 226 may be substantially identical in shape but instead of both the front and rear faces 224, 226 being isosceles trapezoids as in deflector 12, the front and rear faces 224, 226 may be substantially rectangular in shape and similar to rear face 124 of deflector 112.

Figure 8:
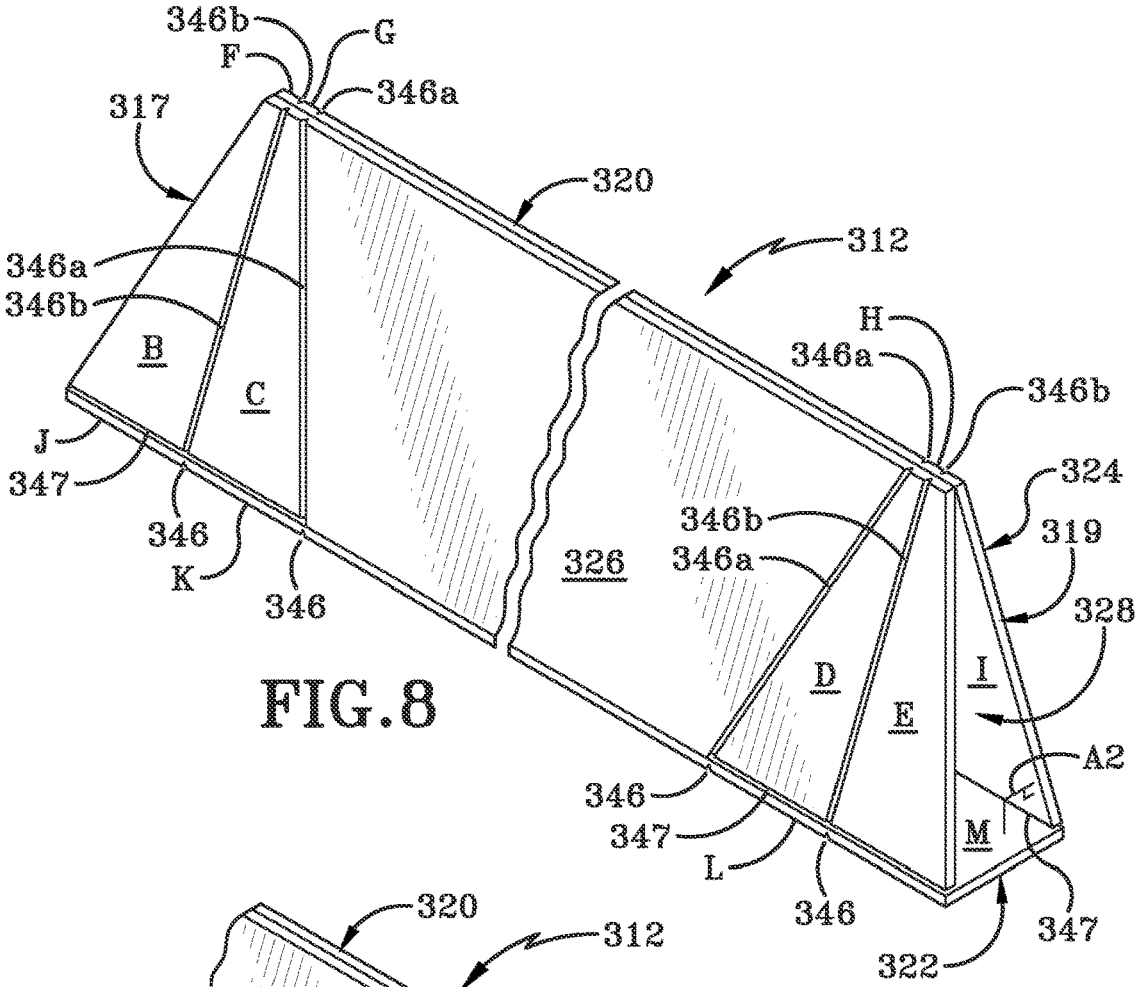
FIG. 8 is a top front perspective view of a fourth embodiment of a deflector in accordance with the present disclosure.
Figure 9:
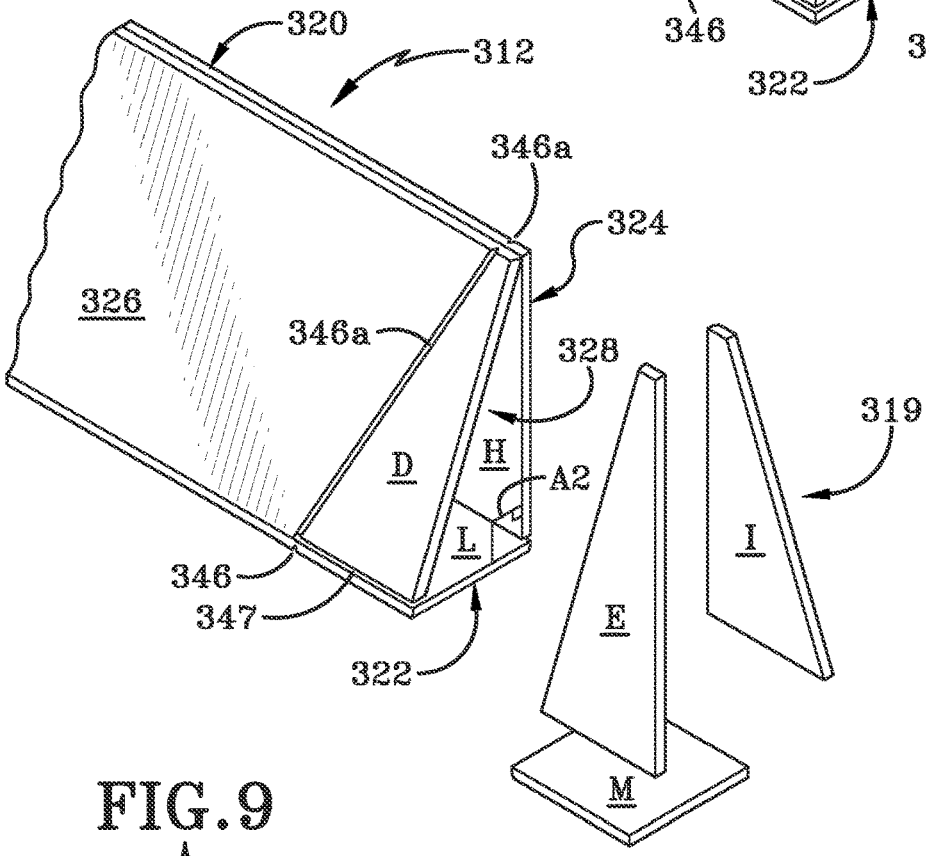
FIG. 9 is a partial top front perspective view of the deflector of FIG. 8 with a few tabs broken off.

With reference to FIGS. 8 and 9 a fourth embodiment of a deflector in accordance with the present disclosure is shown and indicated as reference 312. Deflector 312 is substantially similar to deflector 12, except that the ends 317, 319 are open instead of closed and because one or both of the rear face 324 and front face 326 of deflector 312 may include a plurality of cut lines 346 formed therein. The cut lines 346—may be pre-marked or pre-scored into rear face 324 and/or front face 326 and may extend from top face 320 to bottom face 322. The cut lines 346 may be oriented at different angles relative to top face 320 and bottom face 322. For example, cut lines 346*a* (FIG. 8) may be oriented at an angle of about 60° relative to bottom face 322 while cut lines 346*b* may be oriented at an angle of 90° relative to bottom face 322. One or both of top face 320 and bottom face 322 may include additional cut lines 347 that extend from proximate rear face 324 to proximate front face 326.

Cut lines 346, 347 may allow deflector 312 to be reshaped or reconfigured by an installer for quick and easy installation of deflector 312 into or around interior and/or exterior corners in a backing wall. To facilitate such installation, and according to one aspect, where cut lines 346, 347 are pre-scored, it is contemplated that individual sections of rear face 324, front face 326, and/or bottom face 322 can be selectively snapped by hand and removed from deflector 312 to change the size and/or shape of rear face 324, front face 326, top face 320 and bottom face 322 as needed. For example, as best seen in FIG. 8, if the installer removes the sections "B", "C", "D", and "E" from the front face 326, sections "F", "G", "H", and "I" from the rear face 324, and portions "J", "K", "L", and "M" of bottom face 322, he or she will have converted the deflector 312 into the deflector 12 (it will be understood that removing any one of these sections of front face 126 and/or rear face 124 will likewise cause the associated portion of top face 320 to be removed therewith). Removing sections "B", "C", "D", and "E" from the front face 326, sections "F" and "I" from the rear face 324, and portions "J", "K", "L", and "M" of bottom face 322 will convert the deflector 312 into deflector 112. Removing the sections "B" and "E" from the front face 326, sections "F" and "I" from the rear face 324, and portions "J" and "M" of bottom face 322 will convert the deflector 312 into the deflector 212. The installer may alternatively remove only section "B" from deflector 312 to provide a vertical side edge on front face 326. This potential for reconfiguring and resizing the deflector 312 can reduce installation time by removing the need for using a cutting implement, such as a box-cutter or saw to remove pieces of the deflector, and can lower the likelihood of injury occurring during preparation of the deflector 312.

Further, having pre-marked or pre-scored cut lines 346, 347 can reduce error and waste as the angle of each cut is more accurate as compared to having an installer hand cutting deflector 312. This is especially true in instances where the person measuring and/or cutting deflector 312 is less experienced. Additionally, even minor errors in hand cutting deflector 312 can result in gaps being produced in the wrong place. This may result in water being able to penetrate a hand-cut deflector and thereby reach backing wall 50. Having pre-marked or pre-scored cut lines 346, 347 on deflector 312 may reduce or eliminate such errors. According to another aspect, first end 317 and second end 319 of deflector 312 may be pre-cut or manufactured with the desired correct angles e.g. 90° or 60° relative to bottom face 322 to allow deflector 312 to be installed in interior or around exterior corners, as discussed below.

With reference to FIG. 9, pre-marked or pre-scored sections removed from deflector 312 from bottom surface 322, rear face 324, and/or front face 326, during preparation for installation can be repurposed to close off hollow interior 328 of deflector 312. According to one aspect, removed sections of deflector 312 may be reattached as end caps by means of an adhesive, such as caulk, epoxy, or thermoplastic resin, or other known adhesives or connection methods. The joints between faces of deflector 312 adjacent to removed sections and any repurposed sections may be sealed in a suitable manner such that deflector 312 remains substantially watertight. Utilizing removed sections for this purpose may result in less waste being produced during installation of deflector 312 and may prevent the need to seal first and second ends 317, 319 of deflector 312 utilizing additional materials.

It will be understood that it is contemplated that any of the deflectors 12, 112, and 212 may include cut lines similar to cut lines 346, 347 in deflector 312. In applications where first and second ends 16, 18 are removed from deflector 12 in a similar manner as described above with reference to deflector 312, the removed sections that include the first and second ends 16, 18 can be used for the same purpose to reseal deflector 12.

Figure 10:
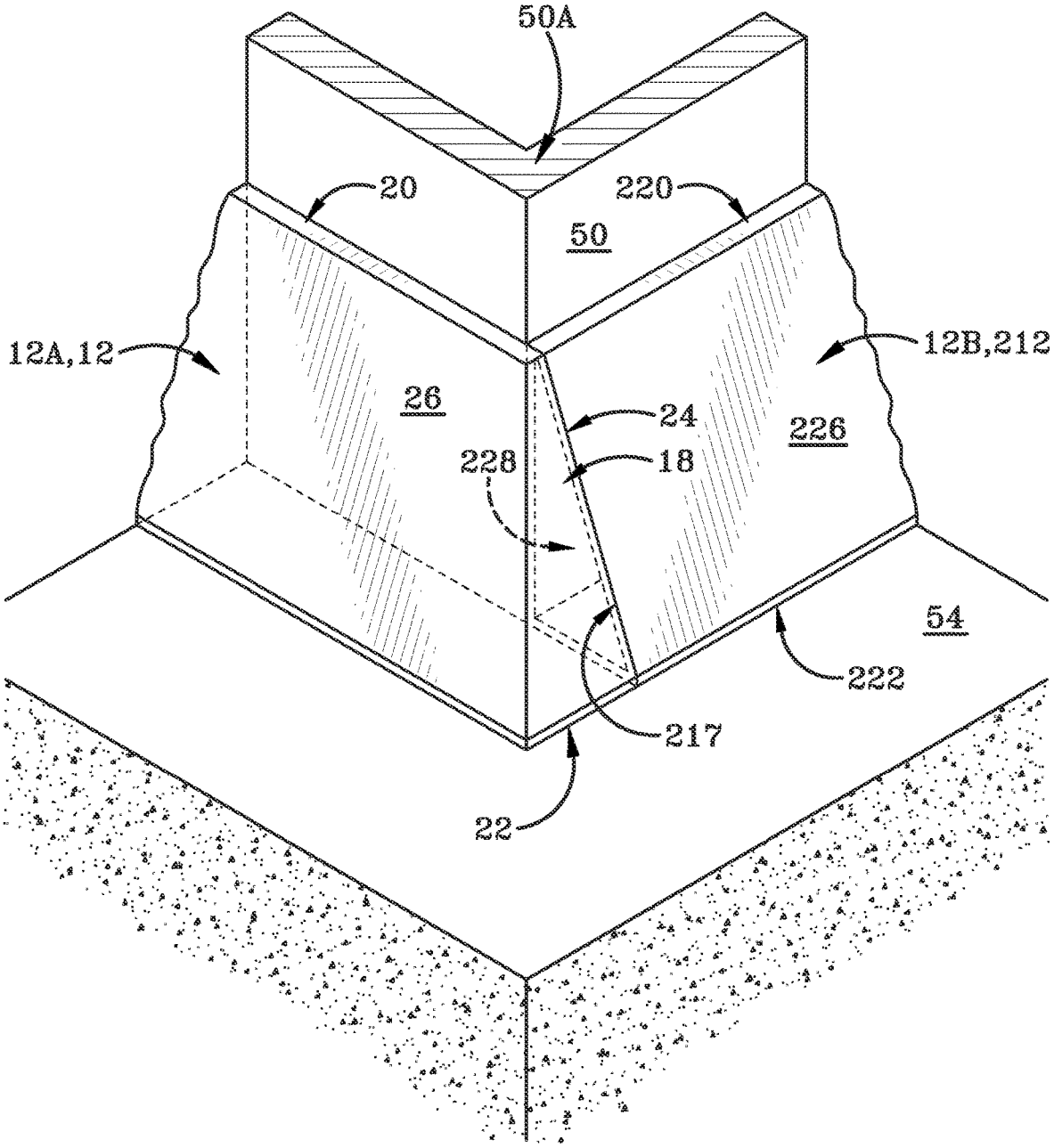
FIG. 10 is a top front perspective view of a combination of the first and third embodiments of the described device installed on an exterior corner of a backing wall.
Figure 11:
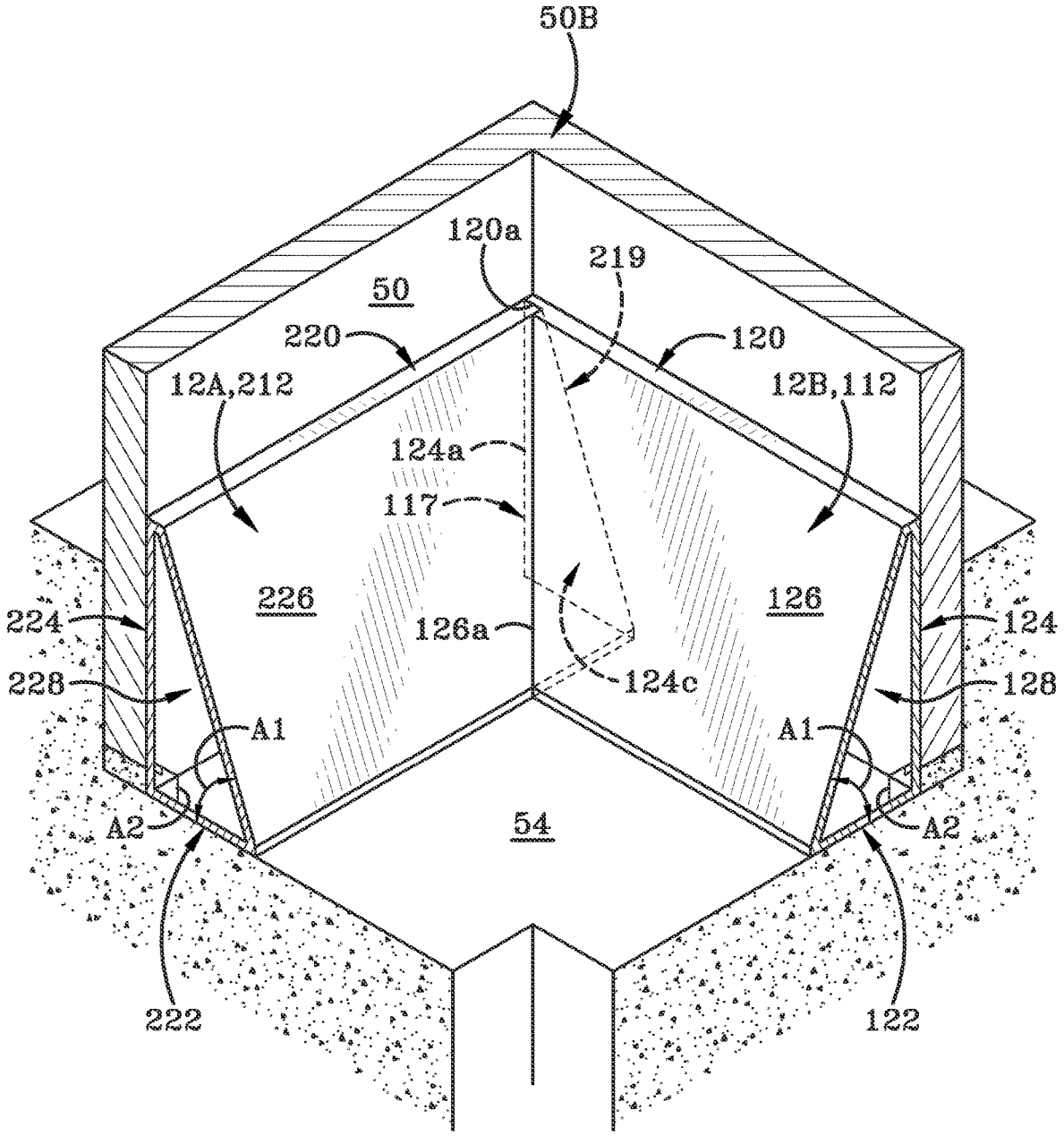
FIG. 11 is top front perspective view of a combination of the second and third embodiments of the described device installed on an interior corner of a backing wall.

With reference to FIGS. 10 and 11, an installer can select any of the deflectors 12, 112, 212, and/or 312 to form a shape of deflector that is complementary to a portion of a backing wall 50. Alternatively, the installer can utilize deflector 312 and snap off appropriate sections along cut lines 346, 347, as described herein, to create the shape deflector they need for a particular portion of backing wall 50. FIG. 10 shows an exterior corner 50A of backing wall 50 while FIG. 11 shows an interior corner 50B of backing wall 50.

Referring now to FIG. 10, when a deflector is installed around an exterior corner 50A of backing wall 50, the installer will select appropriate shaped sections of any of the deflectors 12, 112, 212, and/or 312 to create the corner. As illustrated in FIG. 10, a first deflector section 12A is applied on one face of exterior corner 50A and a second deflector section 12B is applied on the other face of exterior corner 50A. First deflector section 12A may be a portion of deflector 12 wherein the second end 18 thereof may have an angle, such as seen in FIG. 3. First deflector section 12A may extend slightly beyond the first face of exterior corner 50A where it may be joined with second deflector section 12B and affixed thereto to form a watertight seal between the two sections 12A and 12B. As shown in FIG. 10, second section 12B may therefore be a portion of deflector 212 such that the various faces of the first and second deflector sections 12A and 12B may properly align. Specifically, top face 20, bottom face 22, rear face 24, and front face 26 of first section 12A are complementary to the angle of front face 226 second deflector section 12B, while the first end 217 of second section 12B may abut the vertical rear face 24 of first section 12A. Thus, rear face 24 of first section 12A may effective seal or otherwise close access to interior 228 of the second section 12B.

According to one aspect, first and second sections 12A and 12B of exterior corner 50A may be formed from deflector 312 with the appropriate portions snapped off of or otherwise removed from the first and/or second ends 317, 319 thereof, as discussed above. For example, when first section 12A is formed as deflector 12, deflector 312 may be used with sections "B", "C", "D", and "E" removed from the front face 326, sections "F", "G", "H", and "I" removed from the rear face 324, and portions "J", "K", "L", and "M" removed from bottom face 322. Removed sections may be repurposed to seal off access to hollow interior 328 as dictated by the specific installation.

Although shown in FIG. 10 with first section 12A depicted as a portion of deflector 12 and second section 12B as portion of deflector 212, it will be understood that deflectors 12, 112, 212, and/or 312 may be utilized in any combination to form to form exterior corner 50A or other appropriate shapes to complement the backing wall 50. According to one aspect, overlapping, adjacent, or adjoining sections 12A and 12B of deflectors, 12, 112, 212, and/or 312, including portions that may have been removed therefrom and repurposed, may be sealed, adhered, or otherwise affixed to one another. According to another aspect, the seal between sections 12A and 12B may be made as to be watertight.

With reference to FIG. 11, when deflector 12 is installed in an interior corner of backing wall 50, the installer will again select the appropriate shaped sections of any of the deflectors 12, 112, 212, and/or 312 to create the corner. As with the exterior corner, when used in an interior corner a first deflector section 12A is applied on one face of interior corner 50B and a second deflector section 12B is applied on the other face of exterior corner 50B. In an interior corner 50B, first section 12A may be a portion of deflector 212 while second section 12B may be a portion of deflector 112, as depicted in FIG. 11. According to this example, front face 126, top face 120, and bottom face 122 of second section 12B of deflector 112 may be cut or angled in a manner similar to that shown in FIGS. 4 and 5. In this configuration, rear face 124 of second deflector section 12B may be left unaltered, i.e., uncut. Similarly, when preparing second deflector section 12B for installation in an interior corner, top face 120 can be partially cut away, removing only the material formed from front face 126 while leaving top edge of rear face 124 unaltered, thus creating notch 120*a* in first end 117 of deflector 112. Front face 126 and bottom face 122 of second deflector section 12B may further be cut or removed, as in FIGS. 4 and 5 to create edge 126*a* and first region 124*c* that may allow a flush fit with front face 226 of the adjoining first deflector section 12A to maintain a tight seal and appearance, as seen in FIG. 11. Further, the open end 219 of first deflector section 12A may abut the first region 124*c* of the unaltered rear face 124 of second deflector section 12B, effectively sealing off hollow interior 128 of first deflector section 12A with first region 124*c* while simultaneously sealing off access to hollow interior 128 of second section 12B by front face 226 of section 12A.

As with exterior corner 50A, first and second sections 12A and 12B of interior corner 50B may be formed from deflector 312 with the appropriate portions snapped off of or otherwise removed from the first and/or second ends 317, 319 thereof, as discussed above. For example, when second section 12B is formed as deflector 112, deflector 312 may be used with sections "B", "C", "D", and "E" removed from the front face 326, sections "F" and "I" removed from the rear face 324, and portions "J", "K", "L", and "M" removed from bottom face 322. Removed sections may be repurposed to seal off access to hollow interior 328 as dictated by the specific installation. According to one aspect, overlapping, adjacent, or adjoining sections 12A and 12B of deflectors, 12, 112, 212, and/or 312, including portions that may have been removed therefrom and repurposed, may be sealed, adhered, or otherwise affixed to one another. According to another aspect, the seal between sections 12A and 12B may be made as to be watertight.

As with exterior corner 50A, it will be understood that deflectors 12, 112, 212, and/or 312 may be utilized in any combination to form interior corner 50B or other appropriate shapes to complement the backing wall 50. According to one aspect, overlapping, adjacent, or adjoining sections 12A and 12B of deflectors, 12, 112, 212, and/or 312, including portions that may have been removed therefrom and repurposed, may be sealed, adhered, or otherwise affixed to one another. According to another aspect, the seal between sections 12A and 12B may be made as to be watertight.

With reference to FIG. 14 a fifth embodiment of a deflector in accordance with the present disclosure is shown and indicated as reference 412. Deflector 412 may substantially similar to other deflectors 12, 212, 312, and 412 except that the bottom face 422 thereof may have an extension, or drip edge 460, extending outward therefrom. Drip edge 460 may be formed with bottom face 422 as to be integral thereto, or may be formed with deflector 412 as a whole. According to one aspect, drip edge 460 may extend forward of front face 426 by any suitable distance. According to another aspect, drip edge 460 may extend forward of front face 426 by a distance approximately equal to one half the width of a brick used in a veneer, such as veneer 52, as discussed below.

Figure 15:
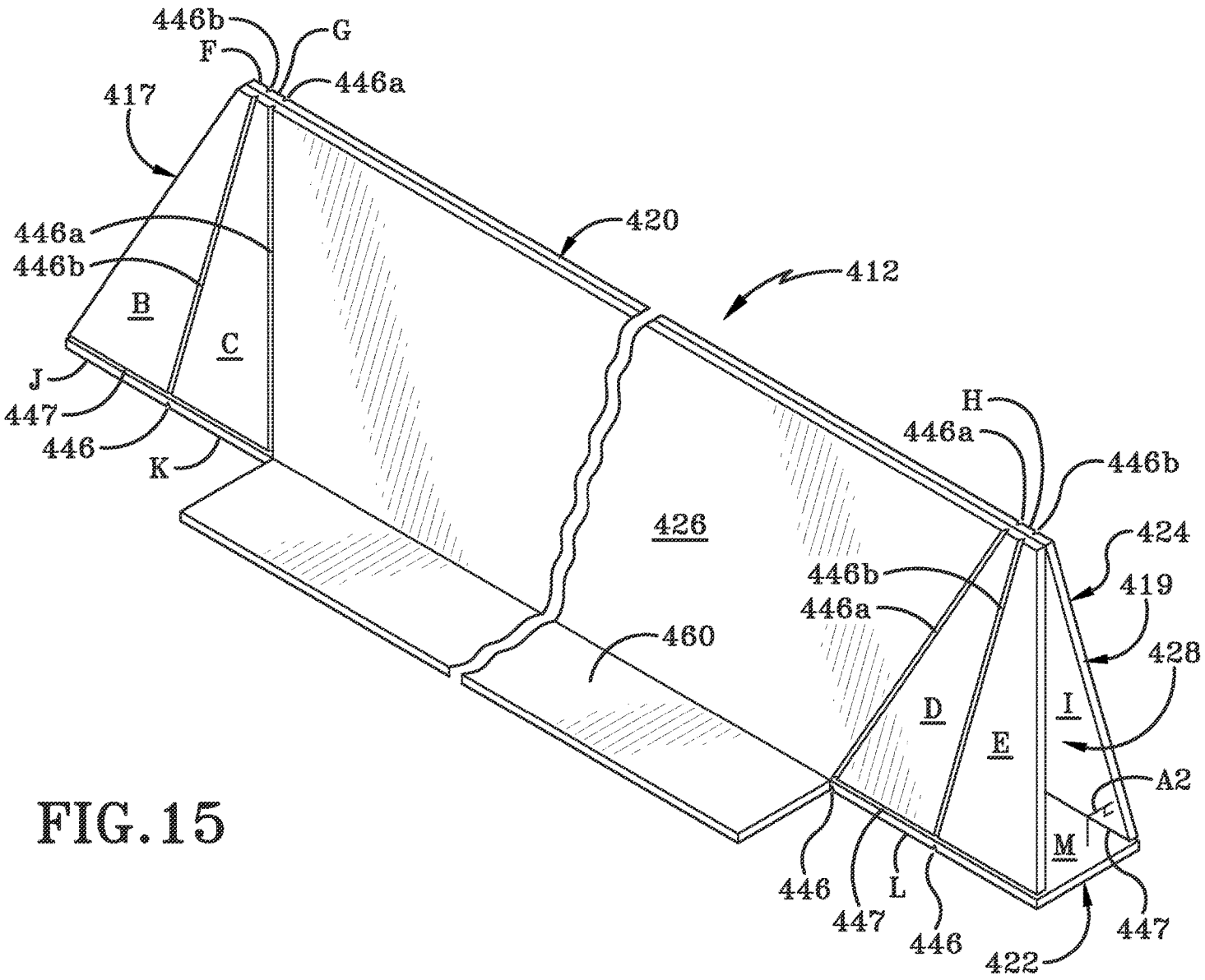
FIG. 15 is a top front perspective view of the fifth embodiment of the grout sealing device in accordance with the present disclosure.

With reference to FIGS. 14 and 15, deflector 412 may include one or more cut lines 446 (similar to cut lines 346) which may be pre-marked or pre-scored into rear face 424 and/or front face 426 and may extend from top face 420 to bottom face 422. The cut lines 446 may be oriented at different angles relative to top face 420 and bottom face 422. One or both of top face 420 and bottom face 422 may include additional cut lines 447 that extend from proximate rear face 424 to proximate front face 426.

According to one aspect, as shown in FIG. 15, it is contemplated that the removable portions of front face 426 (i.e. sections B-E), and/or bottom face 422 (i.e. sections J-M) may not include drip edge 460 formed thereon or therewith. According to another aspect (not shown), one or more of the removable portions of front face 426 and or bottom face 422 may include a drip edge 460 which may be formed therewith, or may be removable therefrom as dictated by the desired implementation.

As with cut lines 346 and 347, cut lines 446 and 447 may allow deflector 412 to be re-shaped or reconfigured by an installer for quick and easy installation of deflector 412 into or around interior and/or exterior corners in a backing wall.

Further, as discussed above with respect to deflector 312, where deflector 412 is implemented with a hollow interior 428, the pre-marked or pre-scored sections removed from bottom surface 422, rear face 424, and/or front face 426 of deflector 412 may be repurposed to close off the interior 428 of deflector 412.

Figure 16:
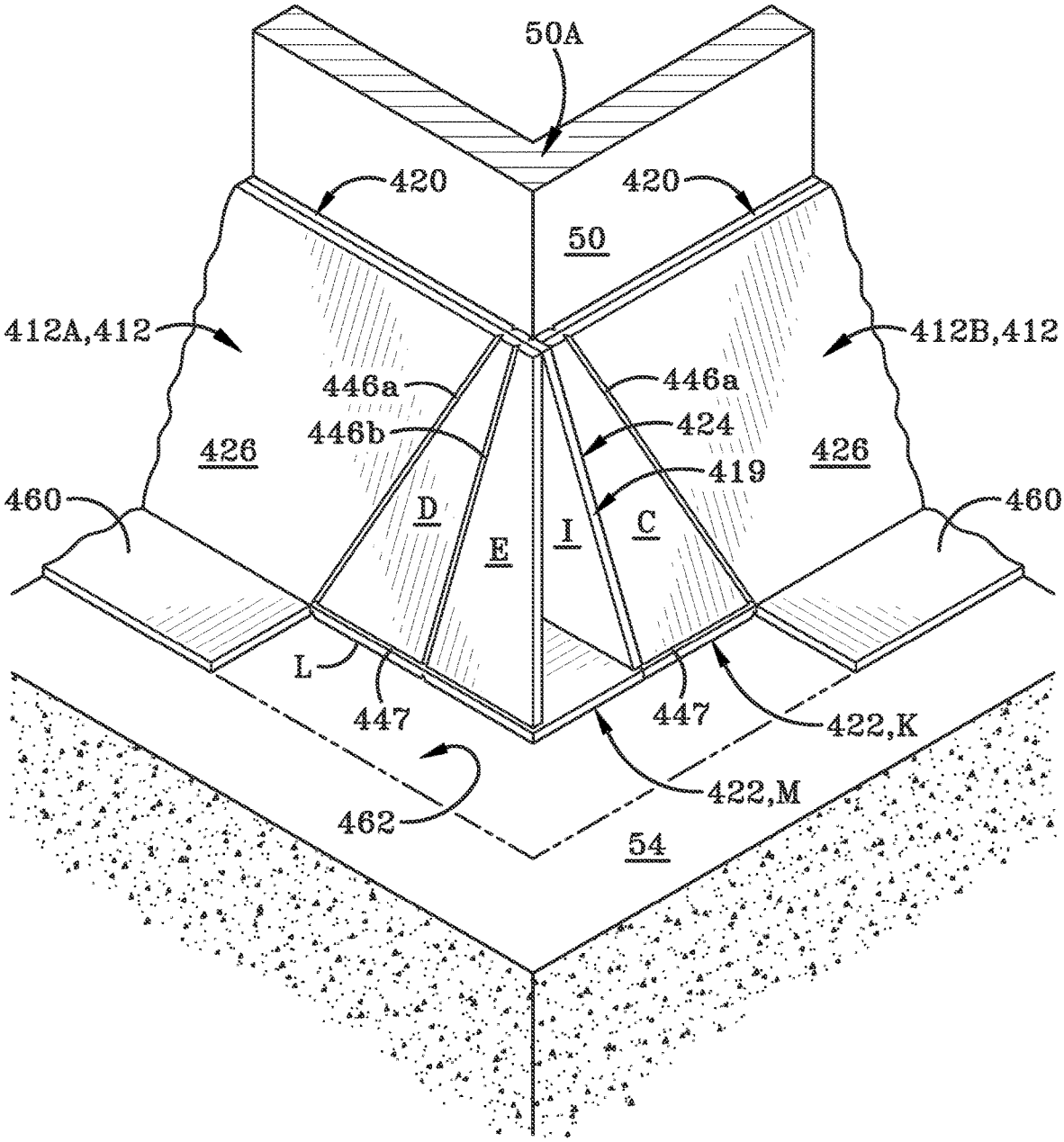
FIG. 16 is a top front perspective view of the fifth embodiment of the grout sealing device installed on an exterior corner of a backing wall.
Figure 17:
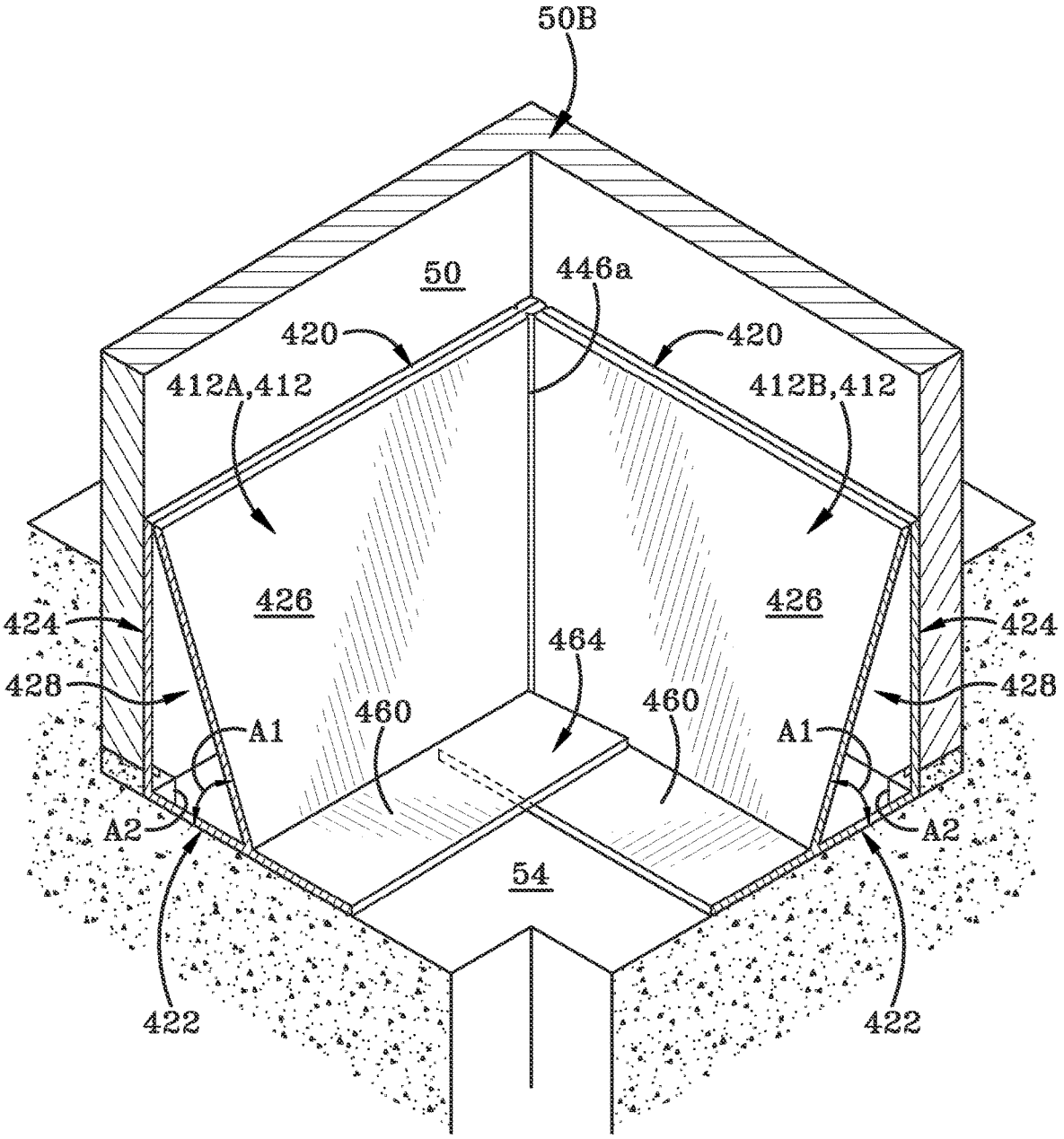
FIG. 17 is a top front perspective view of the fifth embodiment of the grout sealing device installed on an interior corner of a backing wall.

With reference to FIGS. 16 and 17, an installer can select any of the deflectors 12, 112, 212, 312, and/or 412 to form a shape of deflector that is complementary to a portion of a backing wall 50. As illustrated in FIGS. 16 and 17, deflector 412 may be utilized on exterior corners 50A (FIG. 16) and interior corners 50B (FIG. 17). According to this aspect, an installer can remove appropriate sections along cut lines 446, 447, as described herein, to create the shape deflector they need for a particular portion of backing wall 50. Although show as deflector 412, it will be understood that the installer can select any of the deflectors 12, 112, 212, 312, and/or 412 as desired.

Referring now to FIG. 16, when deflector 412 is installed around an exterior corner 50A of backing wall 50, the installer will remove portions of deflector 412 to create the corner. As illustrated in FIG. 16, a first deflector section 412A is applied on one face of exterior corner 50A and a second deflector section 412B is applied on the other face of exterior corner 50A. First deflector section 412A may extend slightly beyond the first face of exterior corner 50A where it may be joined with second deflector section 412B and affixed thereto to form a watertight seal between the two sections 412A and 412B. As shown in FIG. 16, drip edge 460 may extend from portions of both first and second deflector sections 412A and 412B, but not from the removable sections "D", "E", "I", "C", "L", "M", or "K", as shown, and may thus have a space or open span (shown in FIG. 16 as reference 462 and outlined in the dash-dot-dot line form) between the drip edge 460 of first section 412A and the drip edge 460 of the second portion 412B. This space 462 may be filled or taken up by other material, or may be otherwise covered by sealing member 14, as discussed further herein.

According to aspects wherein the removable portions of front face 426 (i.e. sections B-E), and/or bottom face 422 (i.e. sections J-M) include a drip edge 460, the installation on an exterior corner 50A may omit space 462.

Again, although shown in FIG. 16 with first section 412A and second section 12B depicted as portions of deflector 412, it will be understood that deflectors 12, 112, 212, 312, and/or 412 may be utilized in any combination to form to form exterior corner 50A or other appropriate shapes to complement the backing wall 50.

With reference to FIG. 17, when deflector 412 is installed in an interior corner 50B of backing wall 50, the installer will again remove portions of deflector 412 to create the corner. As with the exterior corner 50A, when used in an interior corner 50B a first deflector section 412A is applied on one face of interior corner 50B and a second deflector section 412B is applied on the other face of exterior corner 50B. In an interior corner 50B, first and second sections 412A and 412B may be configured by removing relevant portions to provide the desired profile to match the interior corner 50B. In such installations, it is contemplated that the adjoining first and second sections 412A and 412B will both include at least a portion of drip edge 460. Thus, when arranged in such close configuration, the drip edge of section 412A may overlap the drip edge of section 412B, or vice versa. This overlapping section is indicated at reference 464 in FIG. 17 and may be sealed, adhered, or otherwise affixed together, as desired. Alternatively, according to one aspect, one of the drip edges 460 of either first or second sections 412A or 412B may be trimmed to reduce or eliminate that overlapping section 464. According to another aspect, the drip edges 460 of both sections 412A and 412B may be trimmed at an angle to fit into interior corner 50B as desired by the installer or as dictated by the installation parameters.

As with exterior corner 50A, first and second sections 412A and 412B of interior corner 50B may be formed from deflector 412 with the appropriate portions snapped off of or otherwise removed therefrom, as necessary.

Further, as with exterior corner 50A, it will be understood that deflectors 12, 112, 212, 312, and/or 412 may be utilized in any combination to form interior corner 50B or other appropriate shapes to complement the backing wall 50.

According to one aspect, for any configuration of deflectors 12, 112, 212, 312, and/or 412, overlapping, adjacent, or adjoining sections 412A and 412B, including portions that may have been removed therefrom and repurposed, may be sealed, adhered, or otherwise affixed to one another. According to another aspect, any seals on or between sections 412A and 412B may be made as to be watertight.

It will be further understood that when forming shape complementary to the shape of backing wall 50, regardless of the specific shape thereof, (e.g. exterior corner 50A, interior corners 50B, or the like) deflectors 12, 112, 212, 312, and/or 412 may be altered to provide a form that complements the shape of backing wall 50 while maintain relative relationships between the various faces thereof. For example, when a portion of a deflector 12, 112, 212, 312, and/or 412 is removed or otherwise altered to abut a front face 26, 126, 226, 326, and/or 426 of another deflector 12, 112, 212, 312, and/or 412, the removed portion may result in a remaining edge or face having an angle of approximately 60° to allow for a tight connection to the adjacent front face 26, 126, 226, 326, and/or 426.

Sealing member 14, as described above, will be understood to be applicable with any embodiment of deflector 12, 112, 212, 312, and/or 412 according to the same principles applied to deflector 12. Further, and according to one aspect, deflector 12, 112, 212, 312, and/or 412, can be manufactured and sold with sealing member 14 affixed thereto or may be sold with, but separate from, sealing member 14. According to another aspect, deflector 12, 112, 212, 312, and/or 412 can be produced and sold without sealing member 14. Further, deflector 12, 112, 212, 312, and/or 412 and/or sealing member 14 can be produced and sold in sections of predetermined length thereby allowing an installer to more accurately size deflector 12, 112, 212, 312, and/or 412 and sealing member 14 to meet the specifications of the installation conditions. According to another aspect, deflector 12, 112, 212, 312, and/or 412 and sealing member 14 can be custom produced with or without the pre-marked and/or pre-scored cut lines 346, 347, 446, or 446, as discussed above, to allow installer to quickly adapt deflector 12, 112, 212, 312, and/or 412 to fit the specifications of the desired installation.

It will be further understood that sealing member 14 may be attached to front face 26, 126, 226, 326, and/or 426 of deflector 12, 112, 212, 312, and/or 412 prior to installation of deflector 12, 112, 212, 312, and/or 412 or, alternatively, subsequent to installation of deflector 12, 112, 212, 312, and/or 412, as desired.

According to another aspect, sealing member 14 may be simply placed over deflector 12, 112, 212, 312, and/or 412 and secured to backing wall 50 and/or a horizontal surface 54. According to another aspect, sealing member 14 may be secured only to deflector 12, 112, 212, 312, and/or 412. According to another aspect, sealing member 14 may be secured only to one or both of backing wall 50 and/or horizontal surface 54 in some areas, while being secured to deflector 12, 112, 212, 312, and/or 412 (with or without securing to backing wall 50 or horizontal surface 54 as desired) in other areas. It will be understood that sealing member 14 may therefore be secured to any combination of deflector 12, 112, 212, 312, and/or 412, backing wall 50, and/or horizontal surface 54 in any area as dictated by the desired implementation.

Having thus described various embodiments of a deflector 12, 112, 212, 312, and/or 412 and other components of grout sealing devices 10, 110, 210, 310, and/or 410 in accordance with the present disclosure, the use thereof will now be discussed. In particular, the use of the third embodiment of the grout sealing device deflector 212 is illustrated and discussed with reference to FIGS. 12 and 13 but it will be understood that any of the aforementioned deflectors 12, 112, 212, 312, and/or 412 and/or variations thereof may be utilized with or without a sealing member 14 to form a grout sealing devices 10, 110, 210, 310, and/or 410. As shown in FIGS. 12 and 13, grout sealing devices 10, 110, 210, 310, and/or 410 may be installed within a grout space 48 between a backing wall 50 and an exterior brick veneer 52. Grout sealing devices 10, 110, 210, 310, and/or 410 may be positioned along a base of the backing wall 50 where the backing wall 50 meets the horizontal surface 54.

With continued reference to FIGS. 12 and 13, grout sealing devices 10, 110, 210, 310, and/or 410 may be installed in a grout space 48 formed between a wood backing wall 50 (FIG. 12) or a cinder block backing wall 50 (FIG. 13) and an exterior brick veneer 52. The grout space 48 is generally defined as the gap between backing wall 50 and an exterior veneer 52. Grout space 48 commonly ranges from one to two inches (2.5-5 cm) in width and is provided to allow drainage of water that may seep through the masonry of the exterior veneer 52. Specifically, mortar used with brick or stone veneer 52 is known to be porous and permeable to water. The pressure differential between outside air and air trapped in the grout space 48 further facilitates the seepage of water through the mortar of veneer 52. Once inside the grout space 48, water can run down the interior surface of the veneer 52 or down the exterior surface of a backing wall 50. If not properly addressed, water within grout space 48 may cause moisture related damage to the building.

In accordance with an aspect of the present disclosure, grout sealing devices 10, 110, 210, 310, and/or 410 may therefore be installed at a base of the backing wall 50 where backing wall 50 meets the horizontal surface 54. Water that permeates into the grout space 48 may run down backing wall 50 and/or the interior of the veneer 52 and may further contact the grout sealing devices 10, 110, 210, 310, and/or 410. Grout sealing devices 10, 110, 210, 310, and/or 410 may then direct this water away from the backing wall 50 and towards the veneer 52.

Weep holes 58, which are commonly installed at regular intervals along the base of exterior veneer 52 walls, may then allow water to escape from grout space 48. Specifically, grout sealing devices 10, 110, 210, 310, and/or 410 may direct water that has invaded the grout space 48 towards the veneer 52 and out through weep holes 58. Thus, the combination of grout sealing devices 10, 110, 210, 310, and/or 410 and weep holes 58 may help prevent moisture from penetrating into the backing wall 50 and may help prevent moisture related issues, such as water damage or mold, from developing in backing wall 50 and/or within an interior of the building.

Accordingly, in operation, deflector 212 (as depicted in FIGS. 12 and 13) is contemplated to be placed in the grout space 48 between a backing wall 50 and an exterior veneer 52. Deflector 212 may be placed at the base of backing wall 50 at the junction of backing wall 50 and the building horizontal surface 54. Bottom face 222 and rear face 224 of deflector 212 may form a substantially right angled member (referenced in the figures as angle A2) to facilitate deflector 212 sitting in abutting contact with horizontal surface 54 and backing wall 50 wherein bottom face 222 may sit on horizontal surface 54 and rear face 224 may be positioned in abutting contact with backing wall 50.

Sealing member 14 may be adhered to the backing wall 50 above deflector 212 utilizing adhesive layer 34 or other types of fasteners as described earlier herein. Top edge 38 of sealing member 14 is contemplated to extend vertically behind sheathing paper 56 or house wrap that is typically applied to backing wall 50 during construction. Installation of sealing member 14 may be accomplished by separating removable backing 36 from adhesive layer 34 and pressing adhesive layer 34 into contact with backing wall 50. Removable backing 36 may then be discarded or recycled, as desired. Bottom edge 40 of sealing member 14 may similarly extend outwardly and forwardly beyond deflector 212 and be adhered to horizontal surface 54. Again, removable backing 36 may be disengaged from adhesive layer 34 and adhesive layer 34 may then be pressed into contact with horizontal surface 54. Bottom edge 40 of sealing member 14 can extend across the width of the horizontal surface 54 and terminate with the outermost portion of bottom edge 40 folded down over the outermost edge of horizontal surface 54, as best seen in FIGS. 12 and 13. Veneer 52 may then be constructed on top of bottom edge 40 of sealing member 14.

According to one aspect, sealing member 14 may be cut to fit according to the dimensions of the desired installation. Although sealing member 14 is contemplated to be used with a wood or a masonry backing wall 50 as chosen by a person of skill in the art, sealing member 14 may be adhered to any known material as used in the construction of buildings having a grout space 48. Mechanical fastening of sealing member 14 may be performed by a person of skill if the installation requires or is desirable, without deviating from the scope herein.

In further operation, water that has permeated into or otherwise invaded the grout space 48 may run down the exterior surface of the backing wall 50 or the interior surface of veneer 52 and contact sealing member 14. The front face 226 of deflector 212 causes sealing member 14 to be angled in such a way that water is directed downwardly away from the backing wall 50 and towards the veneer 52. Weep holes 58 at the base of the veneer 52 allow this water to escape from grout space 48.

Figure 18:
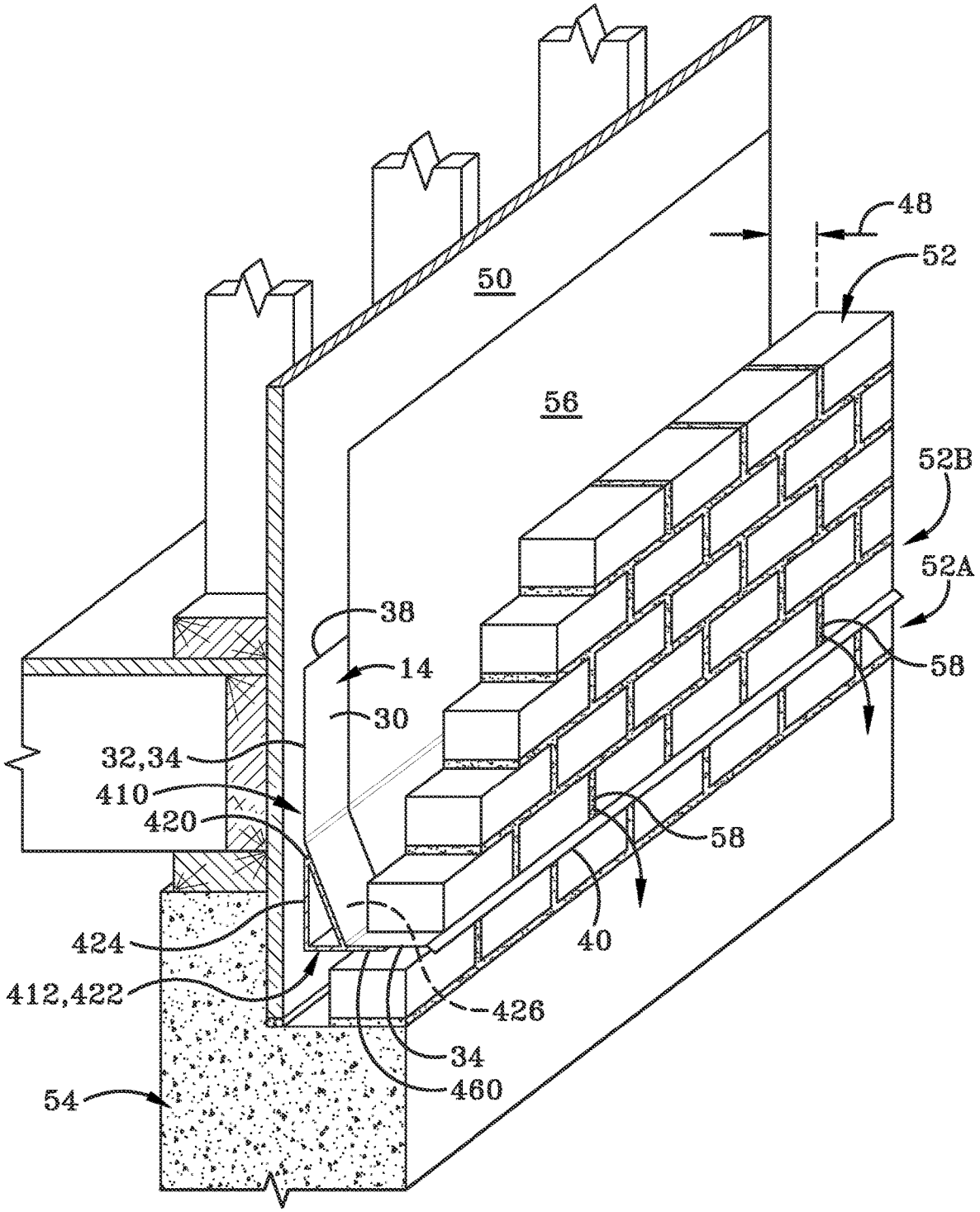
FIG. 18 is a partial cross-section top perspective view of the fourth embodiment of the grout sealing device shown installed in the grout space between a cinder block backing wall and an exterior veneer.

With reference to FIG. 18, an alternative installation of grout sealing device 410, particularly when utilizing deflector 412, is shown and will now be described. In this alternative installation, the grout sealing device 410 (shown as 410 to represent the fifth embodiment including drip edge 460) may be installed between a backing wall 50 and an exterior brick veneer 52. Unlike the previous installation, this version calls for the deflector to be installed above the horizontal surface 54. As seen in FIG. 18, this may be possible by the inclusion of drip edge 460, which may extend between a first layer of brick 52A and a second layer of brick 52B in veneer 52. Specifically, the drip edge 460 may extend forward of front face 426 and into the space between the brick layers 52A and 52B while the sealing member 14 may extend over drip edge 460 and out through veneer 52 as before. The inclusion of drip edge 460 allows for this particular installation in that the integral formation with bottom face 422 provides rigidity and support to deflector 412, keeping it both upright and in position relative to the veneer 52 and backing wall 50. This may further allow use where the width of the grout space 48 exceeds the width of the deflector 412, thus preventing the deflector from sagging or shifting in the oversized space. Further, the inclusion of space below the bottom face 422 of deflector 412 may prevent any irregularities in or on horizontal surface 54 causing an incomplete seal with deflector 412 and sealing member 14. In this configuration, weep holes 58 may be formed though veneer 52 above the drip edge 460 and sealing member 14, thus placing them between the first and second layers 52A and 52B of veneer as well.

Accordingly, in operation, deflector 412 (as depicted in FIGS. 12 and 13) is contemplated to be placed in the grout space 48 between a backing wall 50 and an exterior veneer 52. Deflector 412 may be placed above the junction of backing wall 50 and the building horizontal surface 54. Bottom face 422 and rear face 424 of deflector 412 may form a substantially right angled member (referenced in the figures as angle A2) to facilitate deflector 412 sitting substantially parallel with horizontal surface 54.

As with deflectors 12, 112, 212, and/or 312, sealing member 14 may be adhered to the backing wall 50 above and below deflector 412 utilizing adhesive layer 34 or other types of fasteners as described earlier herein. Further, bottom edge 40 of sealing member 14 may similarly extend outwardly and forwardly beyond deflector 412 along drip edge 460. Bottom edge 40 of sealing member 14 can extend across the width of the veneer 52 and terminate with the outermost portion of bottom edge 40 folded down over the outermost edge of the first layer 52A of brick in the veneer 52, as best seen in FIG. 18. Veneer 52 may then be further constructed on top of drip edge 460 and bottom edge 40 of sealing member 14.

In further operation, as with previous embodiments, water that has permeated into or otherwise invaded the grout space 48 may run down the exterior surface of the backing wall 50 or the interior surface of veneer 52 and contact sealing member 14. The front face 426 of deflector 412 causes sealing member 14 to be angled in such a way that water is directed downwardly away from the backing wall 50 and towards the veneer 52. Weep holes 58 at the base of the veneer 52 may then allow this water to escape from grout space 48.

Grout sealing devices 10, 110, 210, 310, and/or 410, as disclosed herein, are thus contemplated to direct water that enters grout space 48 away from the base of the backing wall 50 and out of grout space 48 through weep holes 58. The placement of grout sealing devices 10, 110, 210, 310, and/or 410 at or near the bottom of grout space 48 can accomplish this task without preventing insulation from being utilized within grout space 48, if appropriate for the desired application.

Additionally, any of deflectors 12, 112, 212, 312, and/or 412, and/or variations thereof may be installed quickly and efficiently by unskilled tradesmen reducing both the cost and time commonly associated with the construction of brick or stone exteriors on a backing wall 50.

It will be understood that while grout sealing devices 10, 110, 210, 310, and/or 410 has been disclosed herein as being generally triangular in cross-section, the device 10 may instead be substantially "L-shaped" in cross-section, or may have any other suitable cross-section shape. Further, grout sealing devices 10, 110, 210, 310, and/or 410 may be comprised of only the bottom face 22, 122, 222, 322, and/or 422 and front face 26, 126, 226, 326, and/or 426 of the deflector 12, 112, 212, 312, and/or 412, for example. In other aspects, device 10 may instead be substantially "U-shaped" in cross-section and be comprised of top face 20, 120, 220, 320, and/or 420, front face 26, 126, 226, 326 and/or 426 and bottom face 22, 122, 222, 322 and/or 422. In yet other instances, the deflector 12, 112, 212, 312, and/or 412 may be square or rectangular in cross-section.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

If this specification states a component, feature, backing wall, or characteristic "may", "might", or "could" be included, that particular component, feature, backing wall, or characteristic is not required to be included. If the specification or claim refers to "a" or "an" element, that does not mean there is only one of the element. If the specification or claims refer to "an additional" element, that does not preclude there being more than one of the additional element.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various aspects of the disclosure are examples and the disclosure is not limited to the exact details shown or described.

What is claimed:

1. A deflector for sealing a grout space comprising:

a bottom face having a drip edge extending outward therefrom;

a front face in operable connection to the bottom face and oriented at an angle of less than 90 degrees relative thereto, wherein the drip edge of the bottom face extends forward of the front face; and a rear face extending upwardly from the bottom face and oriented at an angle of approximately 90 degrees relative thereto, wherein the rear face is adapted to be positioned parallel to a backing wall, the bottom face, front face, and rear face connected to form a substantially right triangle wherein the front face defines the hypotenuse thereof;

the deflector being adapted to be installed between a backing wall and an exterior veneer with the drip edge of the bottom face secured between a first layer and a second layer of the exterior veneer.

2. The deflector of claim 1 wherein the deflector is adapted to be installed above a horizontal surface and not in contact therewith.

3. The deflector of claim 2 wherein the deflector is operable to direct water that has permeated the exterior veneer away from the backing wall and out of one or more weep holes defined in the exterior veneer.

4. The deflector of claim 1 further comprising:

one or more pre-scored cut lines provided on at least one of the front face, the rear face, and the bottom face of the deflector.

5. The deflector of claim 4 wherein the front face, the rear face, and the bottom face are reconfigurable to form a corner deflector by snapping off at least a portion of one or more of the front face, the rear face, and the bottom face of at least one section of the deflector along the one or more pre-scored cut lines.

6. The deflector of claim 5 wherein the front face, the rear face, and the bottom face are reconfigurable to form an exterior corner adjacent an exterior corner of the backing wall.

7. The deflector of claim 5 wherein the front face, the rear face, and the bottom face are reconfigurable to form an interior corner adjacent an interior corner of the backing wall.

8. The deflector of claim 1 further comprising:

a sealing member positionable over the front face of the deflector, the sealing member extending in a first direction beyond a top edge of the front face, in a second direction forward of the front face above the first portion of the bottom face, and in a third direction beyond a forward edge of the drip edge of the bottom face.

9. The deflector of claim 8 wherein the sealing member further comprises:

a flexible sheet of water impermeable material.

10. The deflector of claim 9 wherein the sealing member further comprises:

an adhesive layer operable to attach the sealing member to the deflector.

11. A method of sealing a grout space provided between a backing wall and an exterior veneer layer, comprising:

placing a deflector having a front face, a rear face, and a bottom face connected to form a substantially right triangle with the front face defining the hypotenuse thereof, between a backing wall and an exterior veneer of a building;

removing at least a portion of one or more of the front face, the rear face, and the bottom face of the deflector along one or more pre-scored cut lines formed thereon;

adjoining a first section and a second section of the deflector to each other to create a corner in the deflector complementary to a corner of the backing wall;

securing a drip edge of the bottom face of the deflector between a first layer of the exterior veneer and a second layer of the exterior veneer to support the deflector in position between the backing wall and the exterior veneer;

directing water that has permeated the exterior veneer along the exterior face of the deflector away from the backing wall and towards the exterior veneer; and draining the water out of the exterior veneer via one or more weep holes.

12. The method of claim 11 further comprising:

positioning a sealing member over the deflector; and extending the sealing member across at least a portion of the backing wall above the deflector and at least a portion of the drip edge of the bottom face of the deflector.

13. The method of claim 11 wherein the drip edge of the bottom face of the deflector extends forward of the front face of the deflector.

14. The method of claim 13 wherein securing the first portion of the bottom face of the deflector between the first layer of the exterior veneer and the second layer of the exterior veneer further comprises:

placing a first layer of the exterior veneer in position across from the backing wall;

placing the deflector in position with the drip edge of the bottom face on top of the first layer of the exterior veneer;

positioning a sealing member over the deflector; and placing a second layer of the exterior veneer in position on top of the sealing member, the drip edge of the bottom face, and the first layer of the exterior veneer.

15. The method of claim 14 wherein the first layer of the exterior veneer is a first course of bricks and the second layer of the exterior veneer is a second course of bricks.

16. The method of claim 11 wherein the removing at least a portion of one or more of the front face, the rear face, and the bottom face of the deflector further comprises:

snapping off the at least a portion of one or more of the front face, the rear face, and the bottom face of the deflector along the pre-scored cut lines.

17. The method of claim 11 wherein adjoining a first section and a second section of the deflector to each other to create a corner in the deflector further comprises:

placing the first section of the deflector adjacent to a corner of the backing wall;

placing the second section of the deflector adjacent to the corner of the backing wall; and adjoining the first and second sections of the deflector to each other to create a corner in the deflector complementary to the corner of the backing wall.

18. The method of claim 17 further comprising:

sealing the first and second sections of the deflector together to be watertight.

* * * * *